US011168477B1

(12) United States Patent
Laydera-Collins

(10) Patent No.: US 11,168,477 B1
(45) **Date of Patent: *Nov. 9, 2021**

(54) APPARATUS AND METHOD FOR HANGING ARCHITECTURAL PANELS WITH CONCEALED ATTACHMENT POINTS

(71) Applicant: Gordon Sales, Inc., Bossier City, LA (US)

(72) Inventor: Imack Laydera-Collins, Benton, LA (US)

(73) Assignee: Gordon Sales, Inc., Bossier City, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/166,600

(22) Filed: Oct. 22, 2018

Related U.S. Application Data

(63) Continuation of application No. 15/130,681, filed on Apr. 15, 2016, now Pat. No. 10,113,317.

(60) Provisional application No. 62/245,693, filed on Oct. 23, 2015, provisional application No. 62/178,617, filed on Apr. 16, 2015.

(51) Int. Cl.

| | |
|---|---|
| ***E04B 9/04*** | (2006.01) |
| ***E04B 9/26*** | (2006.01) |
| ***E04F 13/08*** | (2006.01) |
| ***E04F 21/18*** | (2006.01) |
| ***E04B 9/22*** | (2006.01) |

(52) U.S. Cl.
CPC ..... *E04B 9/0478* (2013.01); *E04B 9/225* (2013.01); *E04B 9/26* (2013.01); *E04F 13/0858* (2013.01); *E04F 21/1844* (2013.01)

(58) Field of Classification Search
CPC ... E04B 9/26; E04B 9/003; E04B 9/18; E04B 9/225; E04B 9/0478; E04F 13/0858; E04F 21/1844
See application file for complete search history.

(56) References Cited

U.S. PATENT DOCUMENTS 1,735,886 A 11/1929 Venzie
1,738,469 A * 12/1929 Weiss ..... E04B 9/26 52/506.09

(Continued)

OTHER PUBLICATIONS

Aluma Vault 3000 / 3000E, Accessible Torsion Spring Panel Ceilings with Concealed Suspension System, Gordon Interior Specialties Division, Apr. 15, 2014, 8 pages.

(Continued)

*Primary Examiner* — Brian D Mattei
*Assistant Examiner* — Charissa Ahmad
(74) *Attorney, Agent, or Firm* — Jones Walker LLP

(57) ABSTRACT

A wall and ceiling panel system which utilizes a concealed resilient beam for securing a panel to a wall or ceiling structure is disclosed. A wall and ceiling panel system having features of the present invention can comprise a panel configured for releasable attachment to a latching assembly. The latching assembly can comprise a resilient beam dynamically secured to a base bracket so as to allow the resilient beam to deflect relative to the base bracket during the panel installation and removal process. The panel can comprise a keyed flange having at least one locking slot configured to mate with the resilient beam, with the panel becoming secured to the latching assembly once the panel's key flange is mated with the resilient beam.

11 Claims, 27 Drawing Sheets

(56) References Cited

U.S. PATENT DOCUMENTS

| | | | | |
|---|---|---|---|---|
| 2,472,756 | A | 6/1949 | Nelsson | |
| 2,740,179 | A | 4/1956 | Flora | |
| 2,809,413 | A | 10/1957 | Wootton | |
| 2,832,212 | A | 4/1958 | Olsen | |
| 2,918,152 | A | 12/1959 | White | |
| 3,017,692 | A | 1/1962 | Bumell | |
| 3,089,569 | A | 5/1963 | Shults | |
| 3,102,614 | A | 9/1963 | Lydard | |
| 3,139,162 | A | 6/1964 | Spangenberg | |
| 3,303,338 | A | 2/1967 | Lyon | |
| 3,327,376 | A * | 6/1967 | Freeman | A47F 5/0006 29/225 |
| 3,339,960 | A | 9/1967 | Gee | |
| 3,363,302 | A | 1/1968 | Haselmo | |
| 3,548,556 | A | 12/1970 | Vermeulen | |
| 3,678,641 | A | 7/1972 | Englund et al. | |
| 3,685,235 | A | 8/1972 | Lang | |
| 3,785,110 | A | 1/1974 | Galloway et al. | |
| 3,871,150 | A | 3/1975 | Murray et al. | |
| 3,875,717 | A | 4/1975 | Moeller | |
| 3,930,338 | A | 1/1976 | Rood | |
| 3,986,314 | A | 10/1976 | Moeller | |
| 4,221,039 | A | 9/1980 | Smith | |
| 4,269,087 | A * | 5/1981 | Wand | B25B 27/14 29/235 |
| 4,270,327 | A | 6/1981 | Van Leeuwen | |
| 4,308,706 | A | 1/1982 | Rijnders | |
| D269,497 | S | 6/1983 | Rogowsky | |
| 4,408,428 | A | 10/1983 | Brooke et al. | |
| RE31,528 | E | 3/1984 | Mieyal | |
| 4,438,613 | A | 3/1984 | Hintsa et al. | |
| 4,484,428 | A | 11/1984 | Sauer | |
| 4,548,010 | A | 10/1985 | Hintsa | |
| 4,556,352 | A | 12/1985 | Resnicow | |
| 4,578,922 | A | 4/1986 | Wendt | |
| 4,646,500 | A | 3/1987 | Smith | |
| 4,660,348 | A | 4/1987 | LaLonde | |
| 5,077,951 | A | 1/1992 | Baker | |
| 5,253,406 | A | 10/1993 | Shere et al. | |
| 5,267,764 | A * | 12/1993 | Hoffman | E04B 9/18 248/340 |
| 5,355,646 | A | 10/1994 | Bischel et al. | |
| 5,428,930 | A | 7/1995 | Bagley et al. | |
| 5,482,240 | A | 1/1996 | Caraher | |
| 5,603,469 | A | 2/1997 | Stocchi | |
| 5,704,100 | A | 1/1998 | Swan | |
| 5,768,850 | A | 6/1998 | Chen | |
| 5,950,508 | A | 9/1999 | Rossi | |
| 5,956,821 | A | 9/1999 | Kurek, III et al. | |
| 6,318,042 | B1 | 11/2001 | Bloom et al. | |
| 6,324,741 | B1 | 12/2001 | Brown | |
| 6,386,077 | B1 | 5/2002 | Hartman | |
| 6,392,886 | B1 | 5/2002 | Lee et al. | |
| 6,467,228 | B1 | 10/2002 | Wendt et al. | |
| 6,814,748 | B1 | 11/2004 | Baker et al. | |
| 7,062,886 | B2 | 6/2006 | Auriemma | |
| 7,255,315 | B2 | 8/2007 | Oh | |
| 7,264,214 | B2 | 9/2007 | Oh | |
| 7,415,803 | B2 | 8/2008 | Bronner | |
| 7,661,234 | B2 | 2/2010 | Voegele, Jr. | |
| 7,730,690 | B2 * | 6/2010 | Miller | E04B 9/18 52/506.05 |
| 7,743,572 | B2 | 6/2010 | Ducharme | |
| 7,788,874 | B2 | 9/2010 | Miller, Jr. | |
| 8,127,513 | B2 | 3/2012 | Gibbs | |
| 8,201,374 | B2 | 6/2012 | Hohmann, Jr. | |
| 8,312,685 | B2 | 11/2012 | Gibbs | |
| 8,464,487 | B2 | 6/2013 | Kenda et al. | |
| 8,474,200 | B2 | 7/2013 | Gerkes et al. | |
| 8,596,008 | B2 | 12/2013 | Waters et al. | |
| 8,726,587 | B2 | 5/2014 | Nuernberger et al. | |
| 9,181,696 | B1 | 11/2015 | Bergman et al. | |
| 9,187,896 | B1 | 11/2015 | Bergman et al. | |
| 9,187,897 | B1 | 11/2015 | Bergman et al. | |
| 9,879,424 | B1 | 1/2018 | Underkofler et al. | |
| 2001/0052212 | A1 | 12/2001 | Bernardino | |
| 2002/0083672 | A1 | 7/2002 | Ostenfeldt | |
| 2003/0145547 | A1 | 8/2003 | Kliegle et al. | |
| 2004/0016184 | A1 | 1/2004 | Huebsch et al. | |
| 2004/0118068 | A1 | 6/2004 | Kliegle et al. | |
| 2005/0034402 | A1 | 2/2005 | Johnson | |
| 2006/0157297 | A1 | 7/2006 | D'Antonio | |
| 2007/0193131 | A1 | 8/2007 | Ortiz | |
| 2007/0193187 | A1 | 8/2007 | O'Connor | |
| 2010/0095606 | A1 | 4/2010 | Bankston | |
| 2010/0115741 | A1 | 5/2010 | Trifari, Jr. | |
| 2012/0023853 | A1 | 2/2012 | Gerkes et al. | |
| 2013/0214118 | A1 | 8/2013 | Jeswani et al. | |
| 2015/0211231 | A1 | 7/2015 | Bergman et al. | |
| 2015/0308112 | A1 | 10/2015 | Holdridge | |
| 2015/0345139 | A1 | 12/2015 | Underkofler et al. | |
| 2016/0059397 | A1 | 3/2016 | Chern | |
| 2016/0135307 | A1 | 5/2016 | Schieren | |
| 2016/0145863 | A1 | 5/2016 | Bergman et al. | |
| 2016/0208488 | A1 | 7/2016 | Fladeland et al. | |
| 2018/0054914 | A1 | 2/2018 | James et al. | |

OTHER PUBLICATIONS

Wall Systems, Gordon Interior Specialties Division, Apr. 15, 2014, 8 pages.

Column Enclosures, Column Covers, Beam Wraps & Column Surrounds, Gordon Incorporated, Apr. 15, 2014, 8 pages.

RADIANS—Metal, Curving Modular Metal Ceiling System, Ceilings Plus, Mar. 2014, 1 page.

Wrap, Column Covers product brochure, Fry Reglet Engineered Product Systems, Fry Reglet Design Guide Edition 17, Apr. 15, 2014, 24 pages.

METALWORKS Torsion Spring/Torsion Spring Exterior, Armstrong Ceiling Solutions, Apr. 15, 2014, 3 pages.

METALWORKS Torsion Spring Panels, Armstrong Ceiling Solutions, Apr. 15, 2014, 16 pages.

Metal Ceilings, Plank & Tile Hook-On, Hunter Douglas Ceilings, Apr. 15, 2014, 1 page.

Rockfon SpanAir Clip-In Concealed Metal Panel, Roxul Rockfon, Dec. 2015, 2 pages.

* cited by examiner

APPARATUS AND METHOD FOR HANGING ARCHITECTURAL PANELS WITH CONCEALED ATTACHMENT POINTS

CROSS-REFERENCE TO RELATED APPLICATIONS

This application is a continuation of U.S. Ser. No. 15/130,681, filed Apr. 15, 2016 which claims the benefit of U.S. Provisional Application No. U.S. 62/178,617, filed Apr. 16, 2015, and of U.S. Provisional Application No. U.S. 62/245,693, filed Oct. 23, 2015, all of which are hereby incorporated by reference.

BACKGROUND

In the industry of architectural accent assemblies, and more particularly to panels which are used to cover fixed structures such as building walls and ceilings or dressing structural columns, there have been many methods for attaching such accent panels to the fixed structures.

The most common method for mounting wall panels involves the use of a hook/slot mechanism whereby hooks on the panel are coupled to corresponding holes or slots on the support member or structure. Referring to FIG. 1*a*, the typical prior art panel has a hook that can be secured to the support member by slidably coupling the hook to the slot in the support member. This attachment method utilizes gravity to hold the panel in place. However, certain vertical displacement of the panel is required for both installation and removal of the panel. Similar to this method is one using a pin/keyhole-type arrangement. Referring to FIG. 1*b*, either the panel or support member will have a pin, with the other component having a keyhole and adjacent slot. To assemble, the pin will penetrate the keyhole and then be slidably coupled to the slot for locking the assembly in place. Like the hook/slot mechanism, the pin/keyhole mechanism requires vertical displacement of the panel to engage and disengage the pin with the corresponding keyhole.

With both the hook/slot and pin/keyhole mechanisms, vertical displacement of the panels can be inhibited by the positioning of contiguous panels or other components, thereby making it difficult to remove single panels when access to the underlying fixed structure is required. In such instances, the typical prior art solution for wall panels has been the use of a snap fastener mechanism which allows the panel to be releasably secured to the support structure. An exemplary snap fastener mechanism is depicted in FIG. 1*c*. For ceiling panels, the typical prior art solution has been the use of a vertically-oriented torsion spring mechanism whereby a torsion spring engages a slot in the support structure and uses the spring's stiffness to hold the panel in place. An exemplary embodiment of a torsion spring mechanism is shown in FIG. 1*d*. However, while both the snap fastener and torsion spring mechanisms allow for relatively easy panel removal, these mechanisms have limited use where the panels are under heavy environmental (e.g., heavy winds, etc.) or material (e.g., wire conduit, etc.) loads.

SUMMARY

The invention disclosed herein is directed to a wall and ceiling panel system which utilizes a concealed resilient beam for securing the panel to the wall or ceiling structure. Because each panel comprises a keyed flange having locking slots configured for releasable attachment to the resilient beam, the wall and ceiling panel system of the present invention can withstand significantly higher loads than the prior art systems while still allowing for easy, individual panel removal when access to the underlying structure is required.

A wall and ceiling panel system having features of the present invention can comprise a panel configured for releasable attachment to a latching assembly. The latching assembly can comprise a resilient beam (or latch) dynamically secured to a base bracket so as to allow the resilient beam to deflect relative to the base bracket during the panel installation and removal process. The panel can comprise a keyed flange having at least one locking slot configured to mate with the resilient beam. To install the panel, the panel's keyed flange is brought into engagement with the resilient beam of the latching assembly, with the panel becoming secured to the latching assembly upon the panel's locking slot mating with the resilient beam. Due to the stiffness of the resilient beam, the panel will remain in place even under a heavy load. To remove the panel, the resilient beam must be forcibly deformed (e.g., by using the removal tool described herein) to decouple the resilient beam from the panel's locking slot.

In further embodiments of the wall and ceiling panel system of the present invention, the latching assembly can feature a resilient beam having first and second ends, with both the first and the second ends being dynamically secured to the projecting wall(s) of the base bracket. To allow the resilient beam to deflect relative to the base bracket, the projecting wall(s) preferably have lateral, elongated holes through which the first and second ends of the resilient beam are disposed. During the panel installation and removal process, the first and second ends of the resilient beam will move—yet remain within—the elongated holes, thus allowing the resilient beam to deflect while still remaining secured to the base bracket. The resilient beam can take on a variety of shapes and sizes in the various embodiments. For example, in one embodiment, the resilient beam can be a U-shaped metal wire. In another embodiment, the resilient beam can take the form of a tangential torsion spring. And in yet another embodiment, the resilient beam can be a sinusoidal metal wire, wherein both the ends and the middle portion of the sinusoidal metal wire is supported by the projecting wall(s) of the base bracket.

In further embodiments, the panel(s) can further be defined by a front surface, a rear surface, and the keyed flange. The keyed flange may include a latching cut comprising at least one ramp, at least one nose, and at least one locking slot. In certain embodiments, the keyed flange is attached to and extends perpendicularly from the rear surface of the panel. In embodiments where the base bracket comprises two projecting walls, the latching cut is configured to be removably inserted in between the projecting walls of the base bracket and engage a portion of the resilient beam, resulting in a portion of the resilient beam being disposed within the locking slot.

The above summary is not intended to describe each illustrated embodiment or every possible implementation. These and other features, aspects, and advantages of the present invention will become better understood with regard to the following description, appended claims, and accompanying drawings.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages in accordance with the present invention. Advantages of embodiments of the present invention will be apparent from the following detailed description of the exemplary embodiments thereof, which should be considered in conjunction with the accompanying drawings in which.

DETAILED DESCRIPTION

Figure 1A:
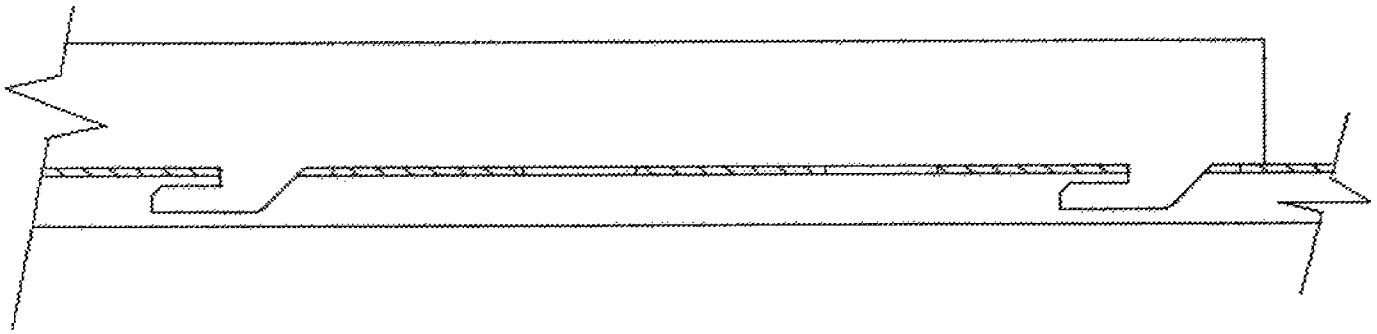
Fig 1a (Prior Art)
FIG. 1*a* is a cross-sectional view of a prior art wall panel system.
Figure 1B:
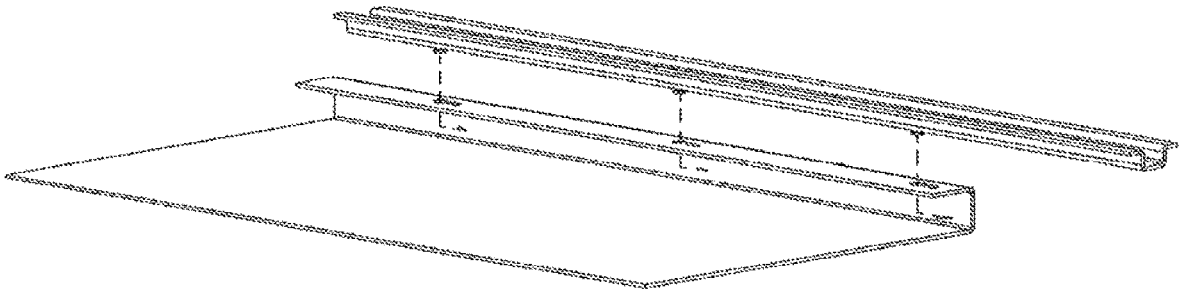
Fig 1b (Prior Art)
FIG. 1*b* is a perspective view of a prior art wall panel system.
Figure 1C:
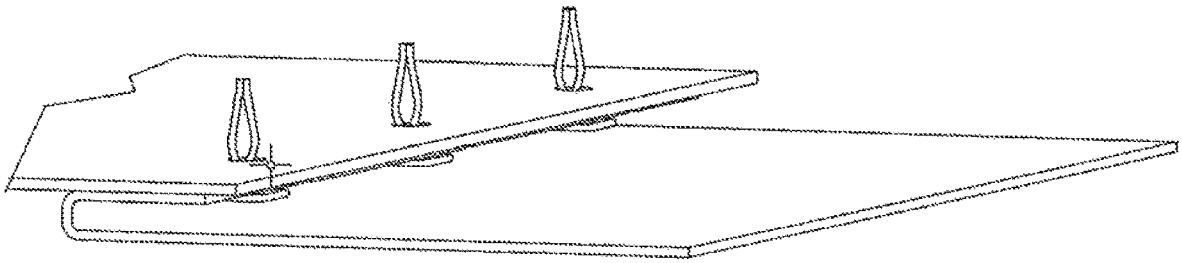
Fig. 1c (Prior Art)
FIG. 1*c* is a perspective view of a prior art wall panel system.
Figure 1D:
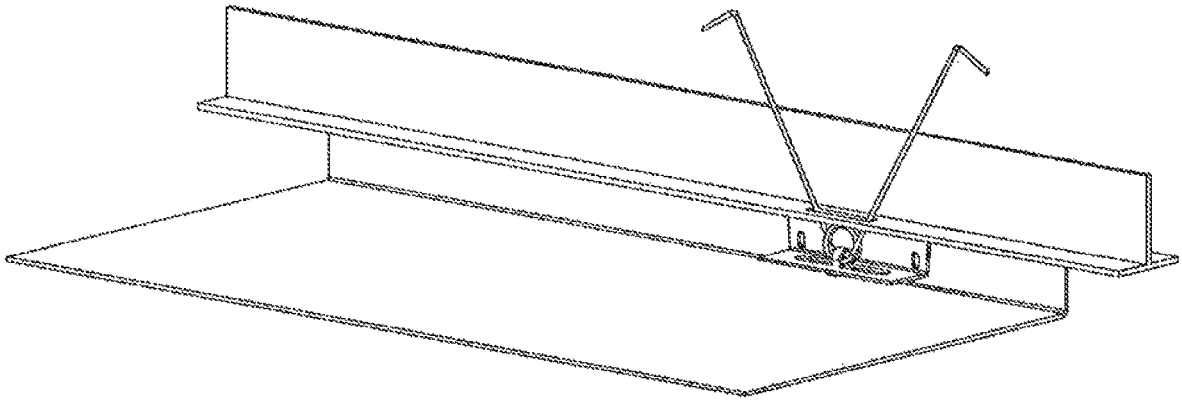
Fig. 1d (Prior Art)
FIG. 1*d* is a perspective view of a prior art ceiling panel system.
Figure 2A:
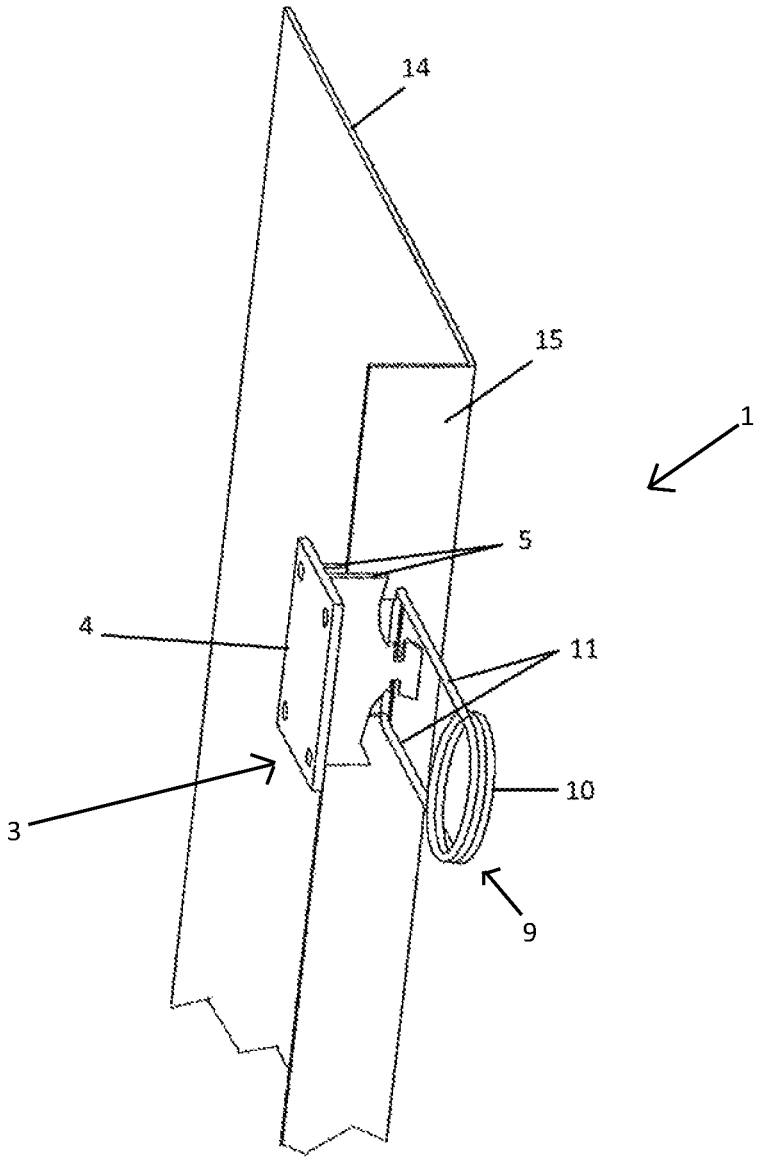
FIG. 2*a* is a perspective view of an embodiment of the wall and ceiling panel system of the present invention whereby a part of the base bracket is cut away to reveal the interaction of underlying components.
Figure 2B:
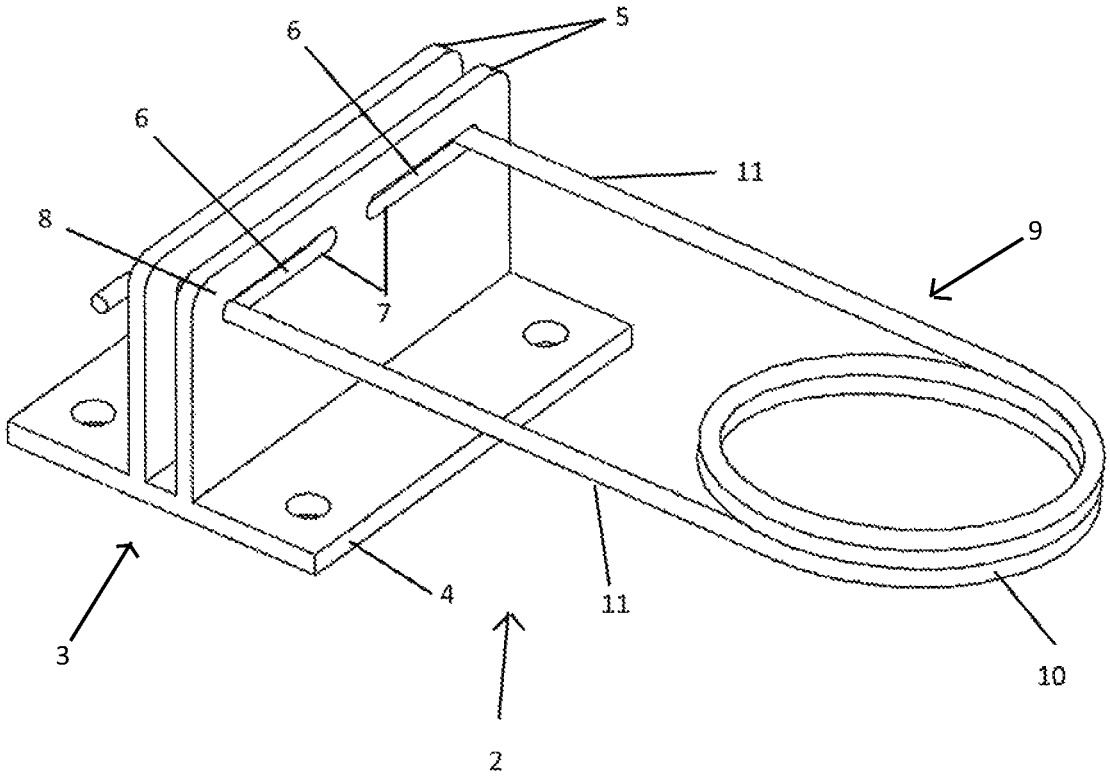
FIG. 2*b* is a perspective view of an embodiment of a latching assembly of the wall and ceiling panel system of the present invention.
Figure 2C:
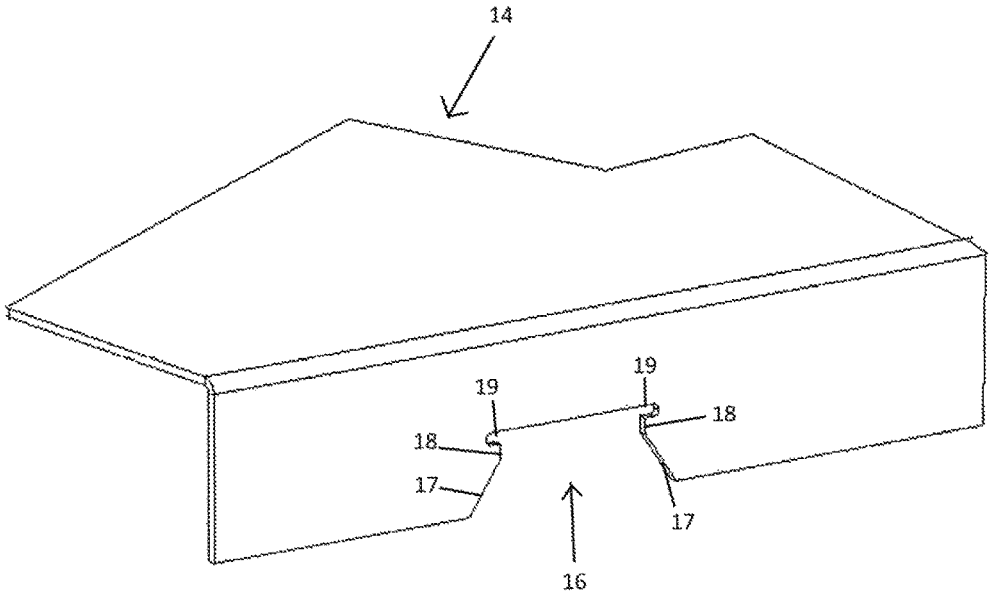
FIG. 2*c* is a perspective view of an embodiment of a panel of the wall and ceiling panel system of the present invention.
Figure 3:
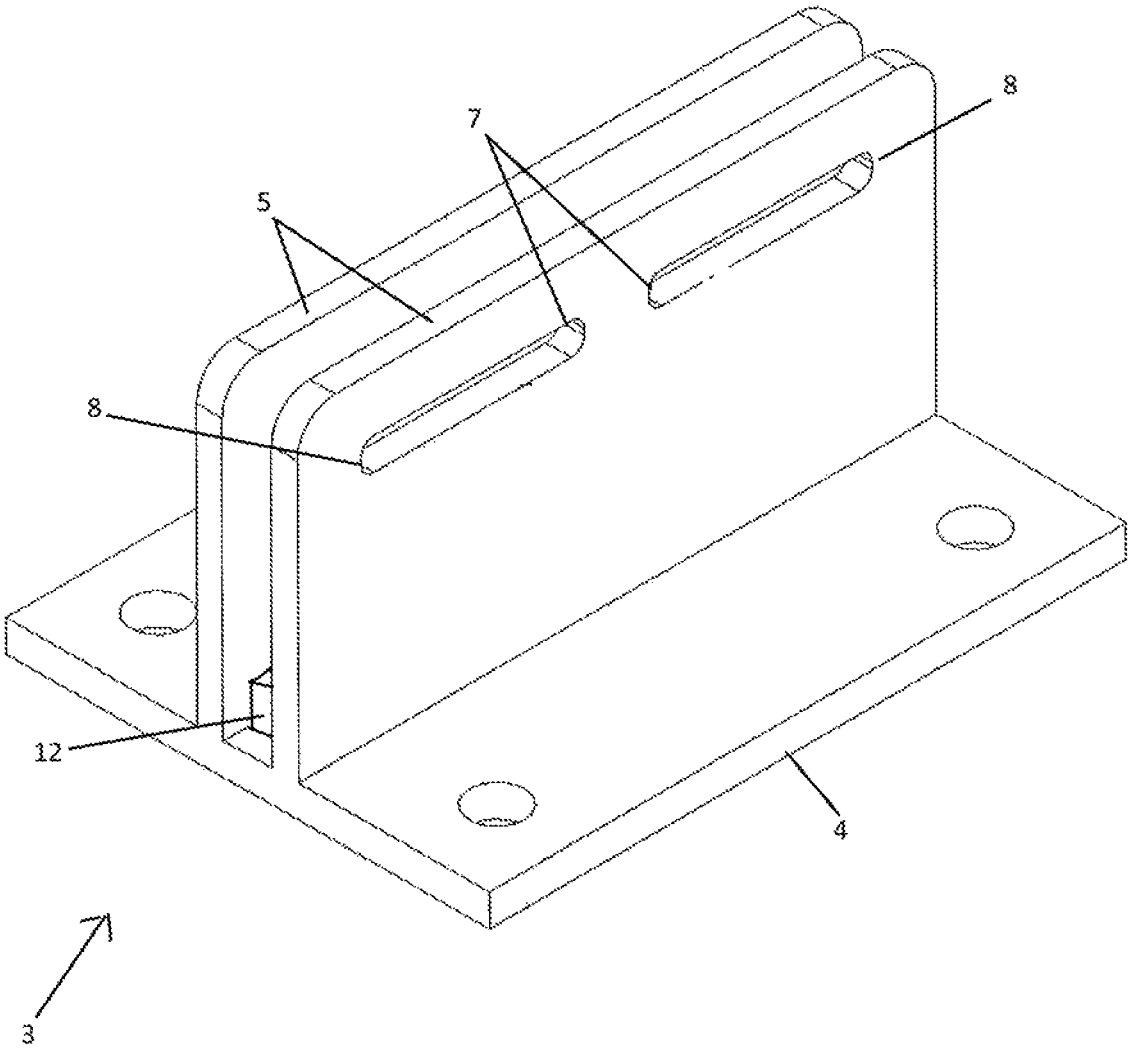
FIG. 3 is a perspective view of an embodiment of the latching assembly's base bracket.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

Referring now to FIGS. 2-8, an embodiment of the wall and ceiling panel system 1 of the present invention is depicted. The wall and ceiling panel system 1 can comprises a panel 14 configured for releasable attachment to a latching assembly 2. The latching assembly 2 can comprise a resilient beam or latch 9 dynamically secured to a base bracket 3 so as to allow the resilient beam 9 to deflect relative to the base bracket 3 during the installation and removal of the panel 14. The panel 14 can comprise a keyed flange 15 having at least one locking slot 19 configured to mate with the resilient beam 9. To install the panel 14, the panel's keyed flange 15 is brought into engagement with the resilient beam 9 of the latching assembly 2, with the panel 14 becoming secured to the latching assembly 2 upon the panel's locking slot 19 becoming engaged with the resilient beam 9. Due to the stiffness of the resilient beam 9, the panel 14 will remain in place even under a heavy load. To remove the panel 14, the resilient beam 9 must be forcibly deformed or deflected to decouple the resilient beam 9 from the panel's locking slot 19.

Figure 4:
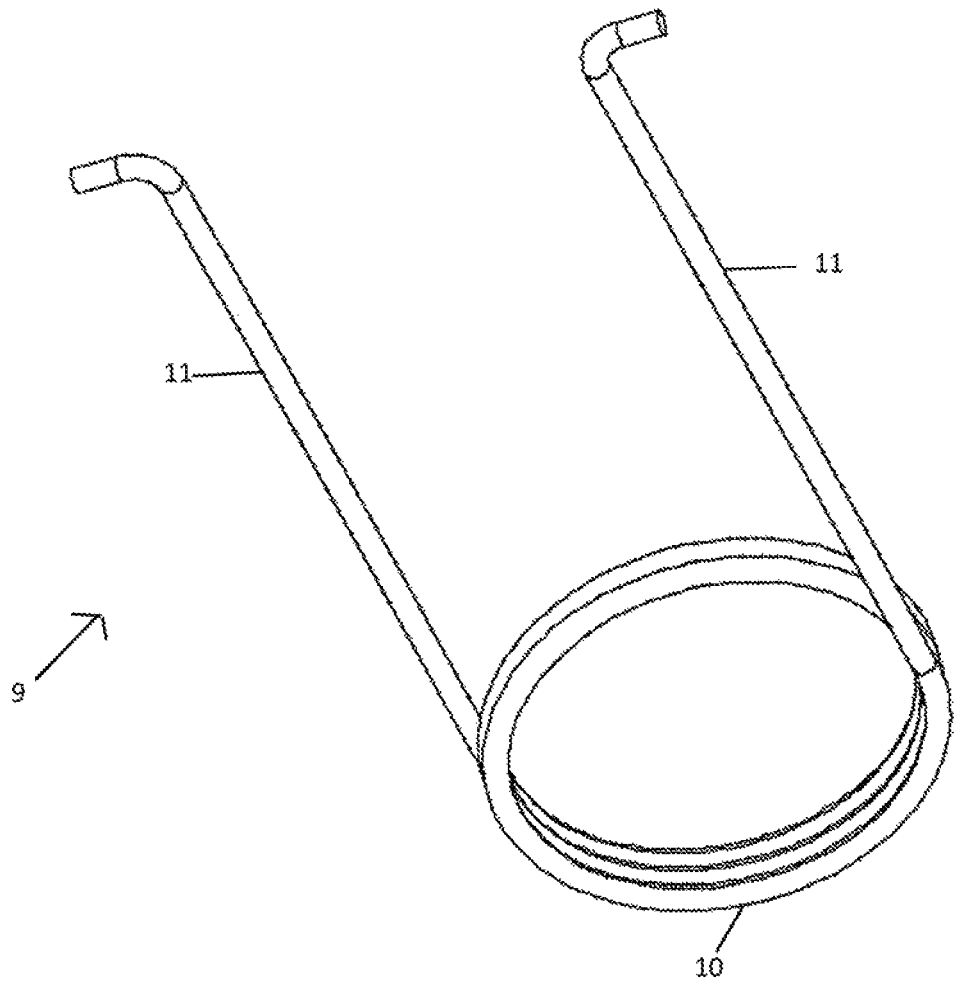
FIG. 4 is a perspective view of an embodiment of the latching assembly's resilient beam.
Figure 5:
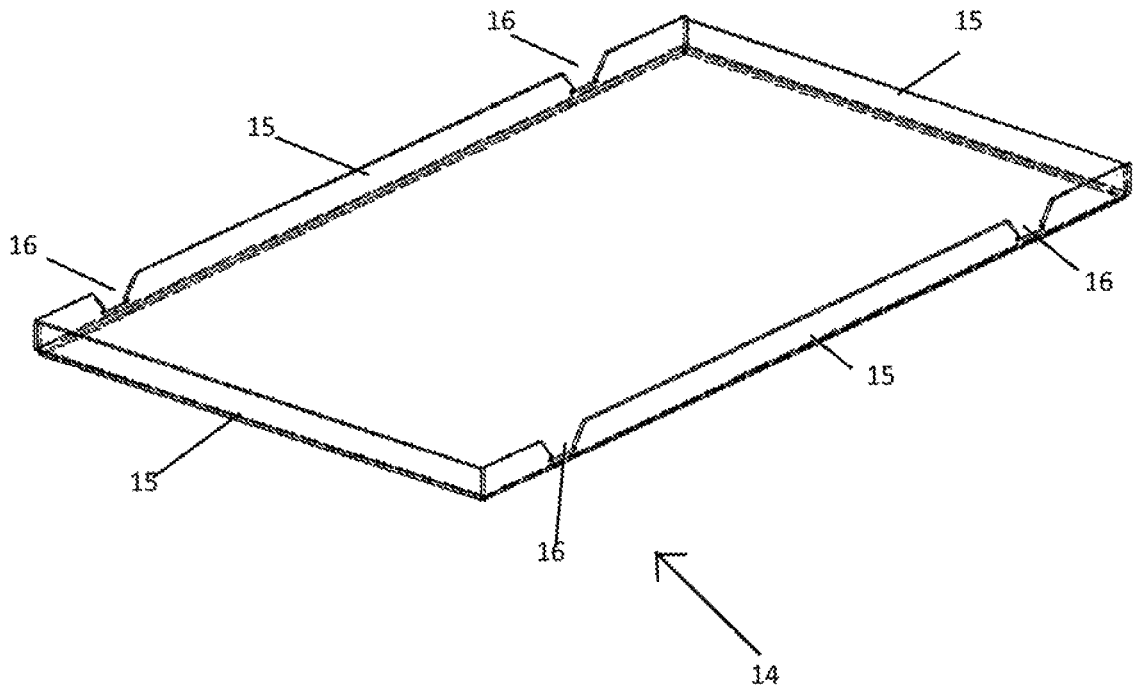
FIG. 5 is a perspective view of an embodiment of a wall and ceiling panel.
Figure 6:
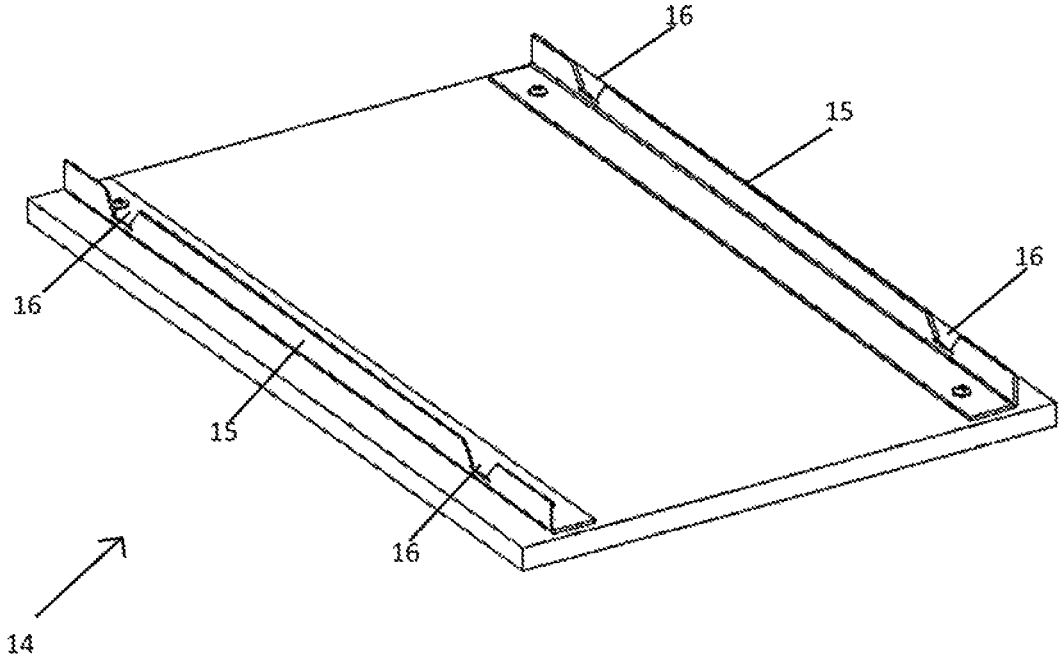
FIG. 6 is a perspective view of an alternative embodiment of a panel suitable for use with the wall and ceiling panel system of the present invention.
Figure 17:
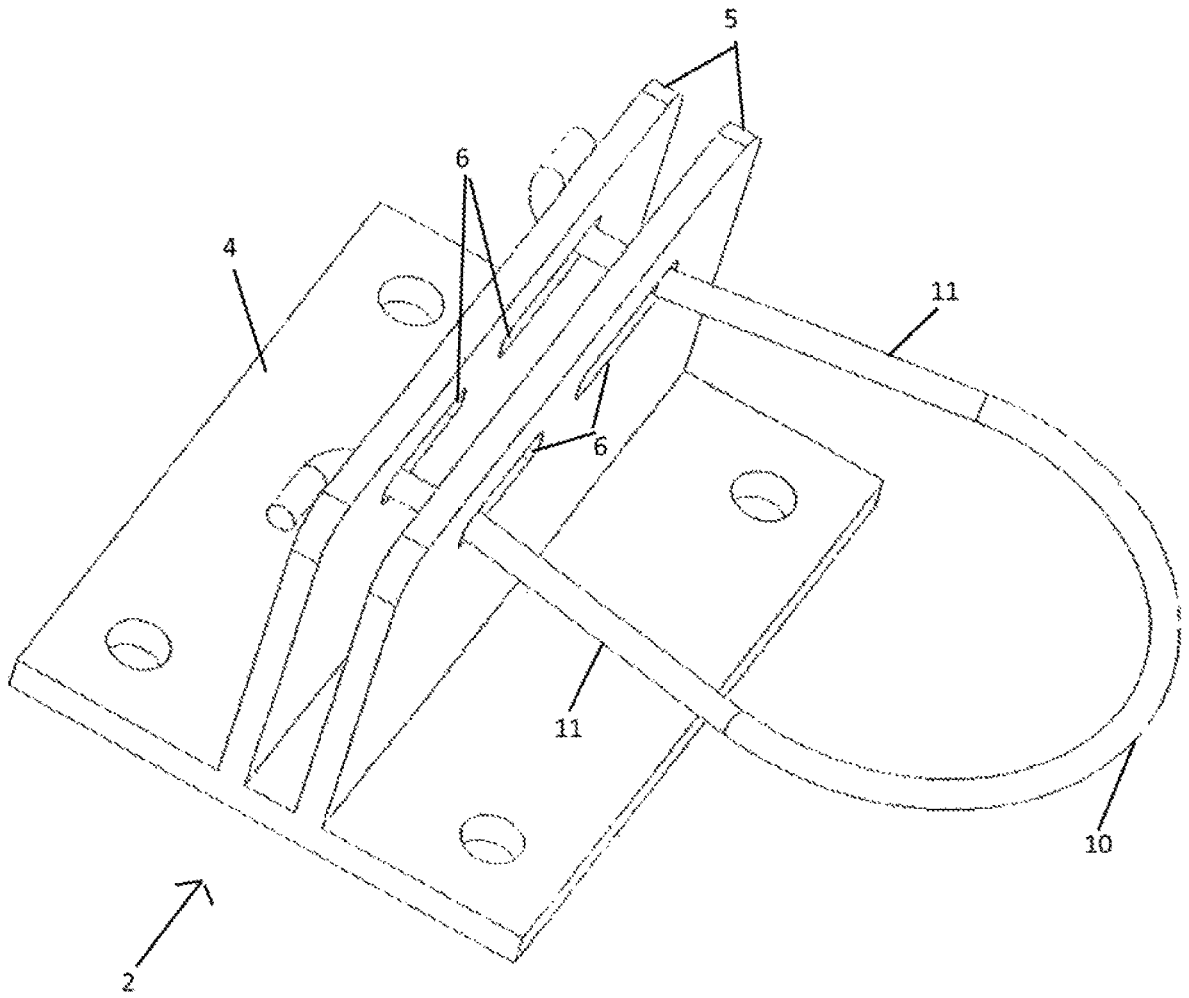
FIG. 17 is a perspective view of yet another embodiment of a latching assembly of the wall and ceiling panel system of the present invention.

Still referring to the embodiment depicted in FIGS. 2-8, the resilient beam 9 can comprise a spring body 10 and two legs 11. The ends of each leg 11 of the resilient beam 9 are dynamically secured to the projecting wall(s) of the base bracket. Specifically, in the embodiment depicted in FIGS. 2-8, the legs 11 are configured to be biased outwardly such that the legs 11 engage corresponding holes 6 in the base bracket 3, thereby securing the resilient beam 9 to the base bracket 3. The resilient beam 9 may be made of any material that is capable of elastically deforming and then returning to its original un-deformed state. In one embodiment, the resilient beam 9 is a tangential torsion wire spring, as shown in FIG. 4. In another embodiment, the resilient beam 9 is a loop spring, as shown in FIG. 17. In yet another embodiment, the resilient beam 9 is a sinusoidal-shaped wire spring, as shown in FIG. 11*c*.

Still referring to FIGS. 2-8, the base bracket 3 is configured for securement to a wall or ceiling structure. The base bracket 3 can include an interface surface 4 and one or more projecting walls 5. In the embodiment shown in FIGS. 2-8, two projecting walls 5 are utilized which generally extend perpendicularly from the interface surface 4. In alternative embodiments, a single projecting wall 5 can be utilized or three or more projecting walls 5 can be utilized. Further, the walls 5 can be non-perpendicular relative to the interface surface 4 in alternative embodiments, with the walls 5 optionally extending from the interface surface 4 in a non-parallel fashion. Each projecting wall 5 preferably comprises two holes 6 for retaining the resilient beam 9 in the base bracket 3. In the embodiment depicted in FIGS. 2-8, holes 6 are elongated, laterally-extending holes. In alternative embodiments, holes 6 may be any shape as long as they are sized such that they can retain the legs 11 of the resilient beam 9 while still allowing the legs 11 of the resilient beam 9 to deflect. Each hole 6 can comprise an inner edge 7 and an outer edge 8. In the embodiment depicted in FIGS. 2-8, the legs 11 of the resilient beam 9 are preloaded outwardly and constrained by the outer edge 8 of the elongated holes 6, thereby securing the resilient beam 9 to the base bracket 3. When the legs 11 of the resilient beam 9 are forcibly deformed (e.g., by using the removal tool described herein) to decouple the panel 14 from the resilient beam 9, the lateral movement of legs 11 inwardly is constrained by the inner edges 7 of the elongated holes 6. In certain embodiments, such as the embodiment depicted in FIG. 3, the base bracket 3 can further comprise a centering block 12 disposed between the projecting walls 5. Once the latching cut 16, is fully engaged with the base bracket 2 (i.e., the legs 11 are locked into locking slots 19), the centering block 12 functions to prevent the longitudinal movement of the panel's keyed flange 15 relative to the base bracket 3, which in turn prevents the longitudinal movement of the panel 14 in relation to the underlying wall or ceiling structure.

As shown in FIGS. 2-8, the panel 14 can comprise a front surface, a rear surface, and a keyed flange 15. The keyed flange 15 is attached to—or can be formed as an integral part of—the rear surface of the panel. In the embodiments shown in FIGS. 2-8, the keyed flange 15 generally extends perpendicularly from the front surface of the panel and features one or more latching cuts 16. However, the keyed flange 15 can extend from the front surface in a non-perpendicular fashion in alternative embodiments. Each latching cut 16 is shaped to releasably engage the resilient beam 9 of the latching assembly 2. In the embodiment depicted in FIGS. 2-8, each latching cut 16 comprises one or more ramps 17 terminating at one or more locking slots 19. The ramps 17 are angled portions of the latching cut 16 that are designed to facilitate the installation of panel(s) 14. The locking slots 19 comprise a groove or slot configured to receive the legs 11 of the resilient beam 9. One or more noses 18 can be formed at the end of ramps 17 and function to delimit the locking slot 19 at the bottom end of the latching cut 16. During installation of the panel 14, the panel's ramps 17 will be brought into engagement with the resilient beam 9 of the latching assembly 2. The angle of the panel's ramps 17 will cause the legs 11 of the resilient beam 9 to deflect inwardly until the legs 11 become engaged with the locking slots 19, thereby securing the panel 14 to the latching assembly 2. In certain embodiments, the keyed flange 15 is formed as an integral part of the panel 14 (see FIG. 5). In other embodiments, the keyed flange 15 is attached to the panel 14 through means known in the art, such as through welding, bolts, screws, washers, etc. (see FIG. 6)

Figure 7:
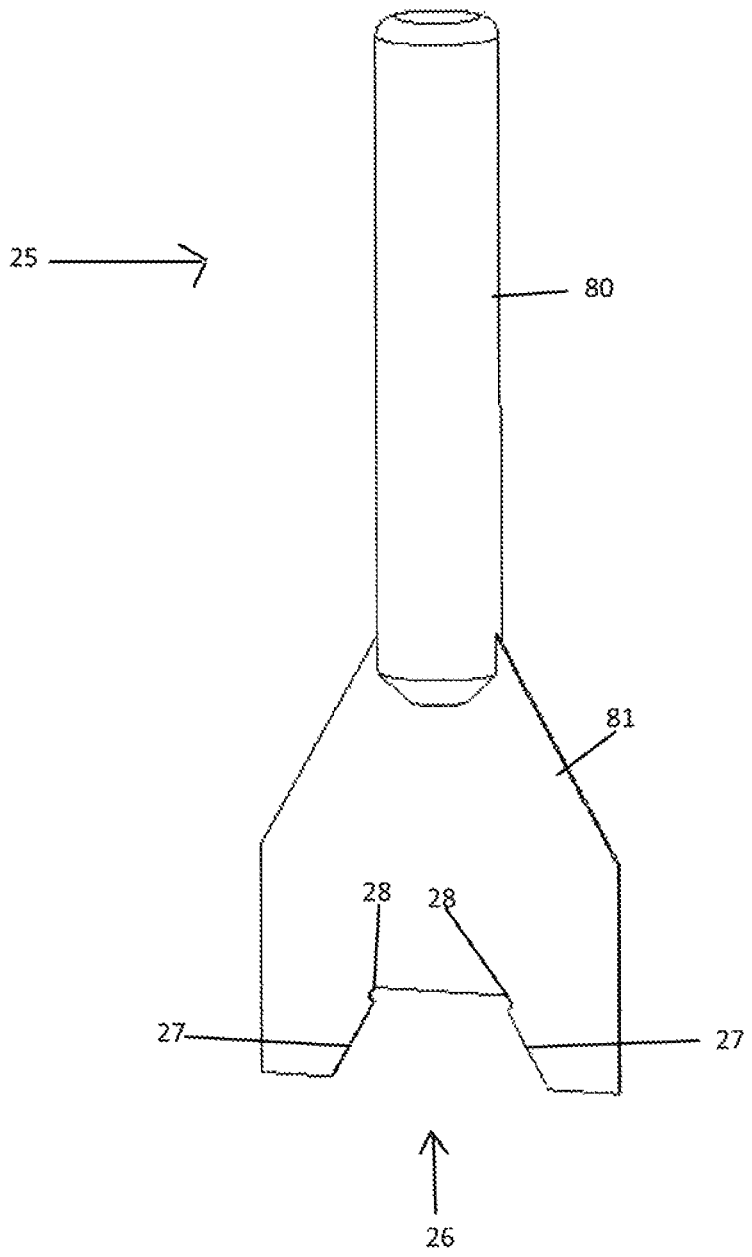
FIG. 7 is a perspective view of an embodiment of a removal tool suitable for use with the wall and ceiling panel system of the present invention.
Figure 8:
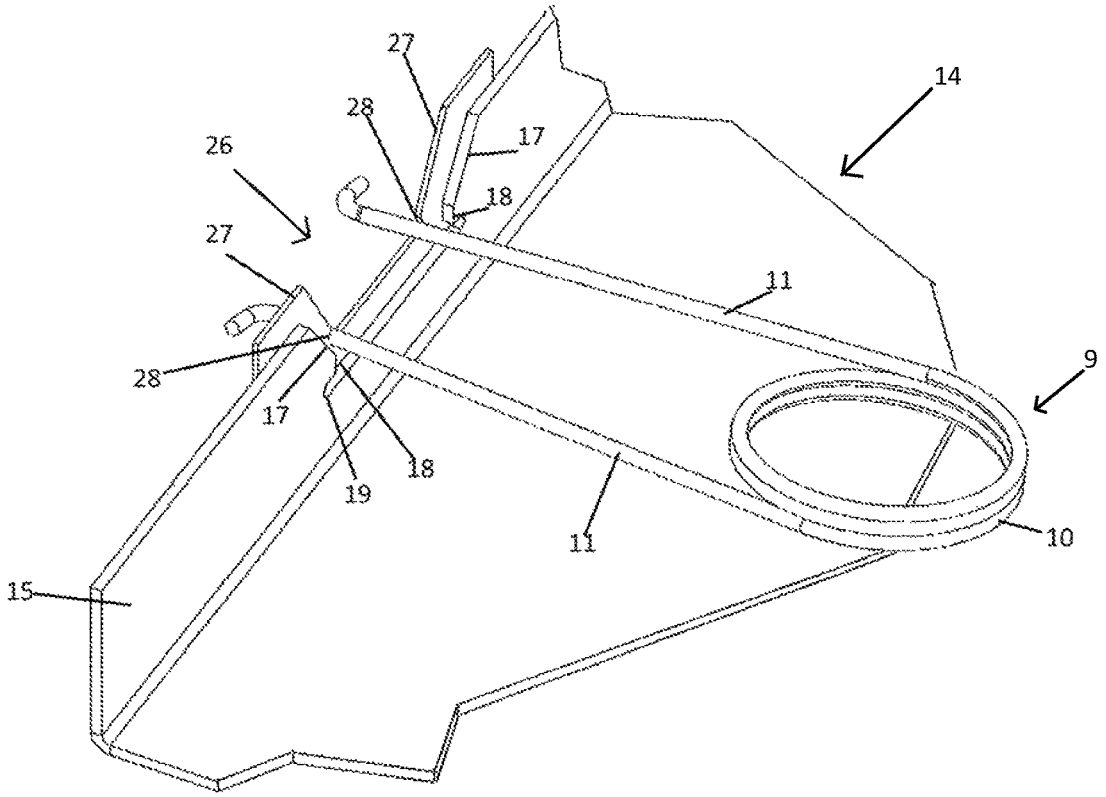
FIG. 8 is a perspective view of an embodiment of removal tool engaging an embodiment of the latching assembly's resilient beam in order to disengage the resilient beam from the panel.
Figure 9A:
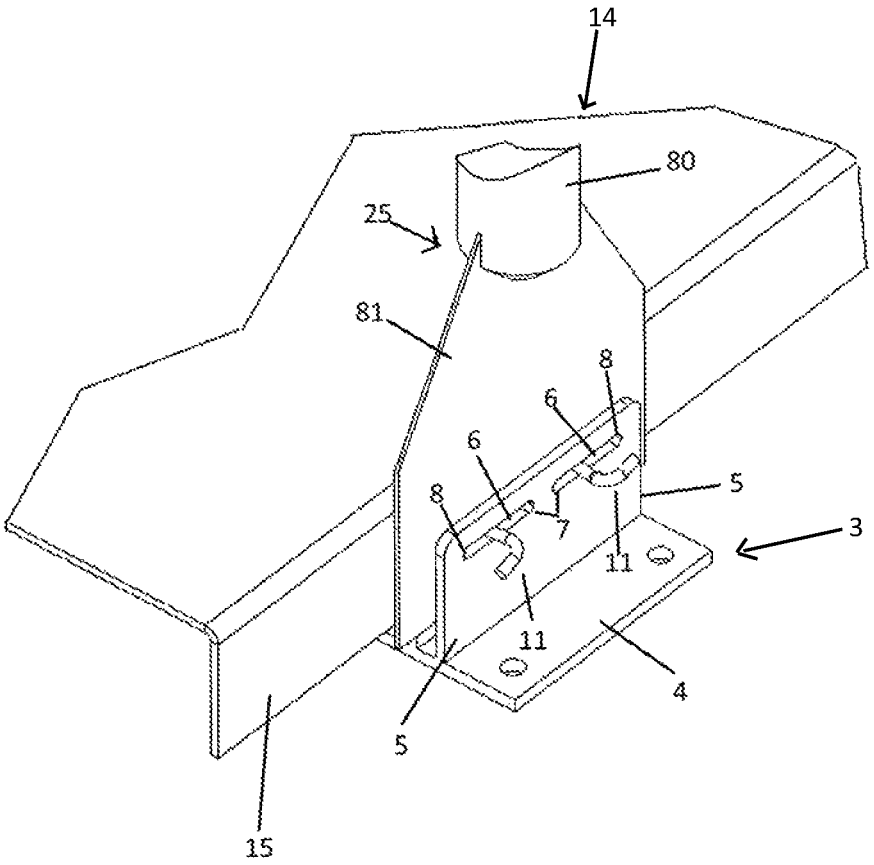
FIG. 9*a* is a perspective view depicting an embodiment of a removal tool engaged with an embodiment of a latching assembly of the wall and ceiling panel system of the present invention.
Figure 9B:
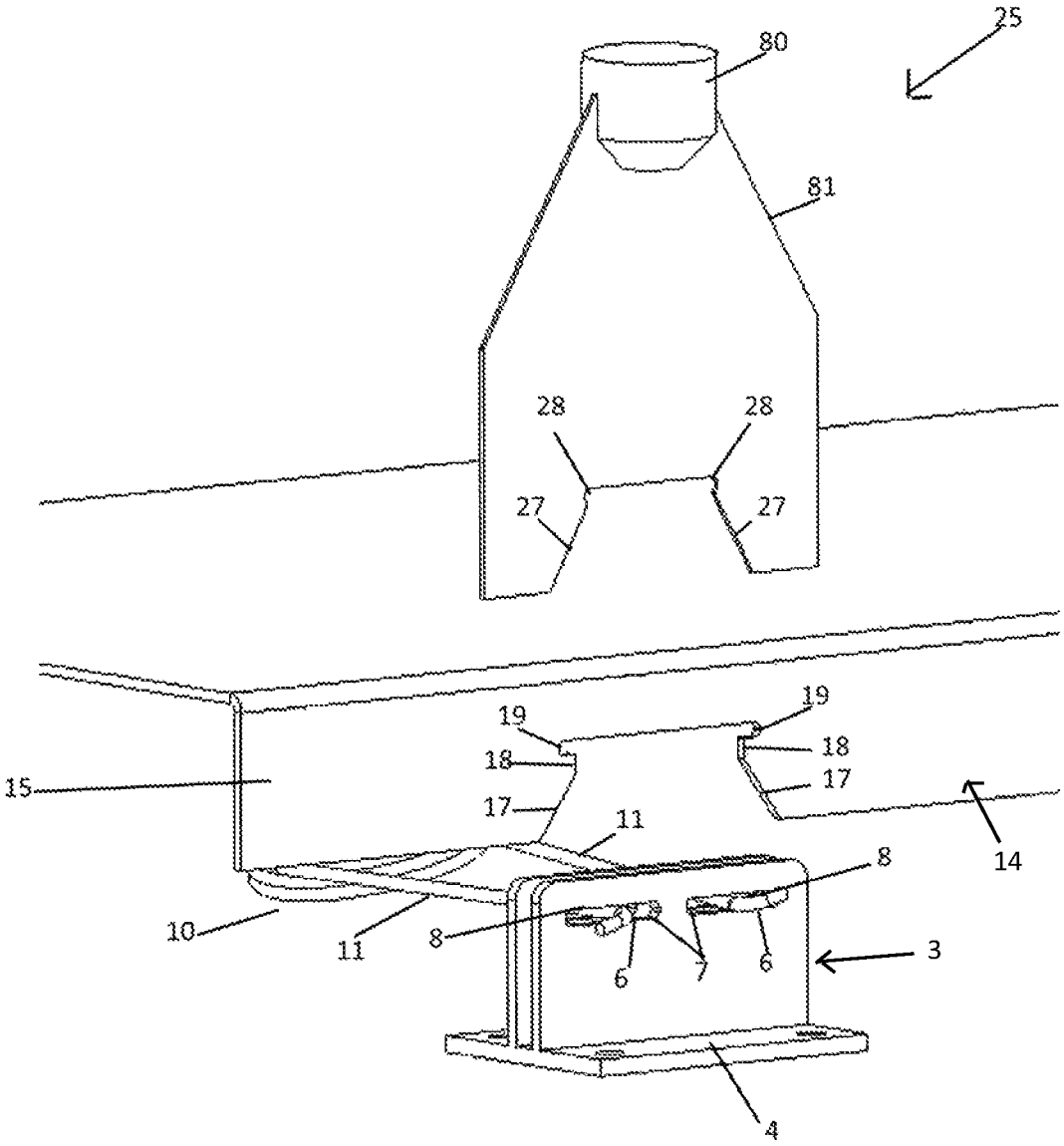
FIG. 9*b* is a partial exploded view depicting an embodiment of a removal tool, a latching assembly, and a panel of the wall and ceiling panel system of the present invention.

To remove the panel(s) 14 from the latching assembly 2, the resilient beam 9 must be forcibly deformed to decouple the resilient beam 9 from the locking slots 19 of the keyed flange 15. To facilitate removal, a removal tool 25 configured to engage and deform the resilient beam 9 is preferably utilized. Various embodiments of a removal tool 25 are shown in FIGS. 7, 9*a*, and 9*b*. The removal tool 25 is sized so that it is capable of being inserted between adjacent panels. The removal tool 25 can comprise a handle 80 and a blade 81. The blade 81 comprises a cut section 26 that is similarly shaped—but of smaller dimensions—to the one or more latching cuts 16 of the flange 15. In operation, the blade 81 of removal tool 25 can be forced into engagement with the resilient beam 9. The removal tool's ramps 27 will slidably engage the legs 11 of the resilient beam 9, causing the legs 11 to deflect inwardly towards the inner edge 7 of the elongated slots 6. This disengages the legs 11 from the keyed flange's locking slots 19. The removal tool 25 can further comprise tool cutout pockets 28 to allow the removal tool 25 to remain engaged to the resilient beam 9 as the panel 14 is being removed. In order to accomplish this, the distance between the narrowest area formed by tool cutout pockets 28 should be smaller than the distance between the narrowest area formed by opposing noses 18 in the latching cut 16.

Figure 10A:
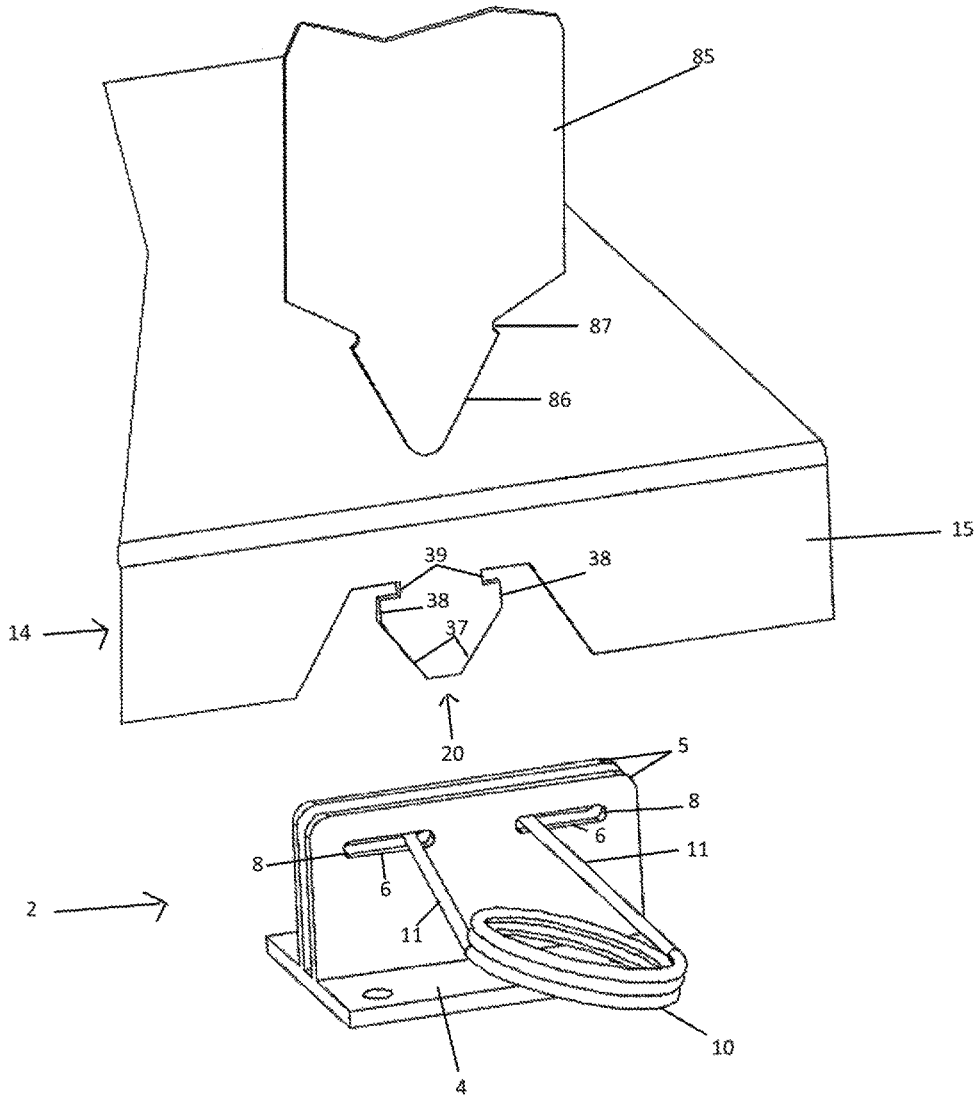
FIG. 10*a* is a partial exploded view depicting an alternative embodiment of a removal tool, a latching assembly, and a panel of the wall and ceiling panel system of the present invention.
Figure 10B:
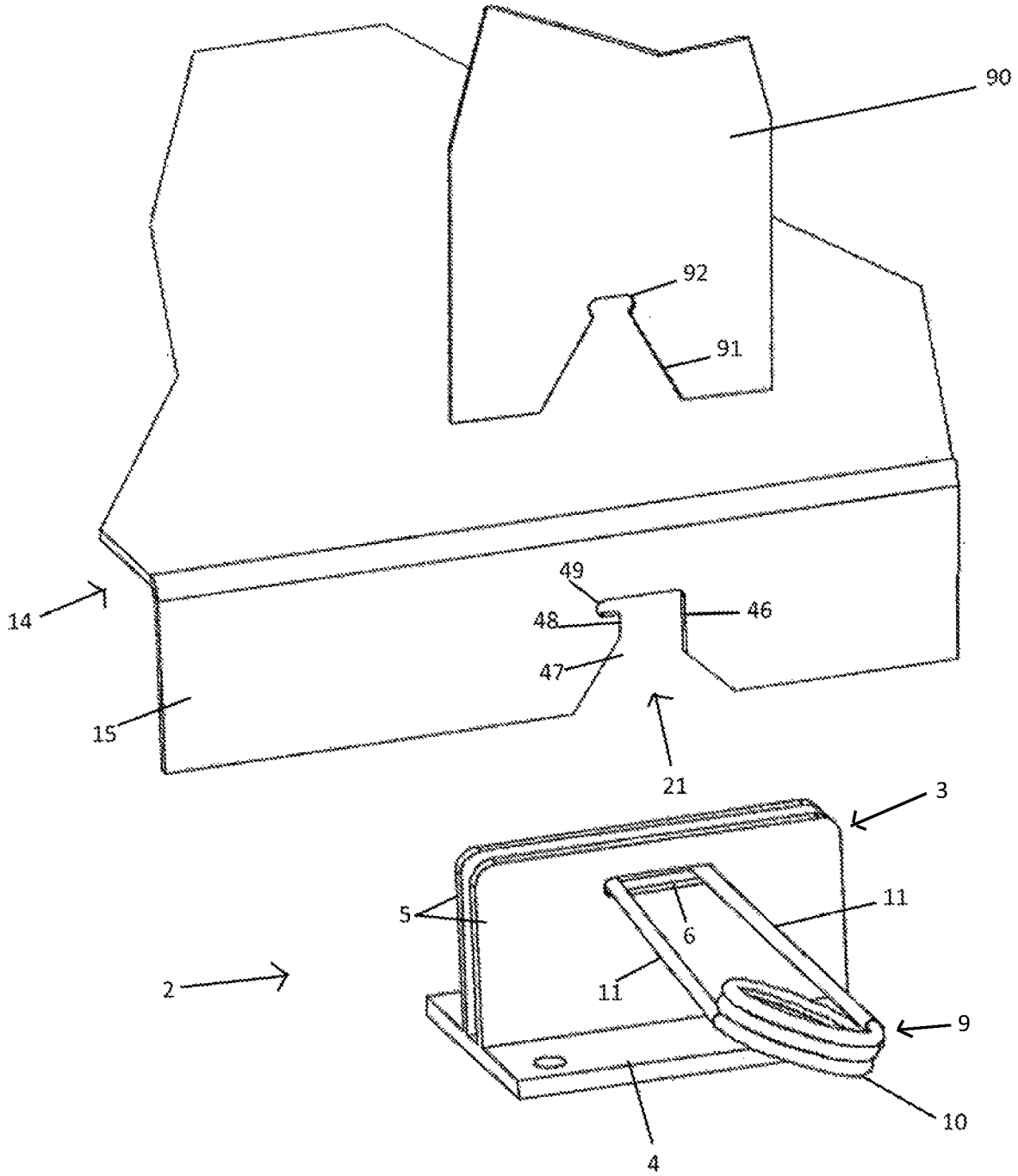
FIG. 10*b* is a partial exploded view depicting yet another alternative embodiment of a removal tool, a latching assembly, and a panel of the wall and ceiling panel system of the present invention.

Now referring to FIGS. 10*a* and 10*b*, alternative embodiments of a panel 14, a latching assembly 2, and a removal tool 85, 90 are depicted. In the alternative embodiment depicted in FIG. 10*b*, a panel 14 having a keyed flange 15 with a single locking slot 49 is shown. In FIG. 10*a*, an alternative embodiment of the wall and ceiling panel system 1 is shown whereby the legs 11 of the resilient beam 9 are biased inwardly. As a result, the keyed flange 15 of the panel 14 is configured with a latching cut 20 designed to engage with an inwardly-biased resilient beam 9. During insertion of the panel 14 into fixed latching bracket 2, the ramps 37 of the latching cut 20 slidably engage the legs 11 of the resilient beam 9 and force the legs 11 outwardly within the elongated holes 6 of the base bracket 3 until the resilient beam 9 becomes engaged with the panel's locking slots 39. For removal, a removal tool 85 can be utilized having tool ramps 86 and tool cutout pockets 87. When the removal tool blade 85 is inserted between panels 14 and forced into engagement with the legs 11 of the resilient beam 9, the legs 11 will be forced outwardly, thereby causing the legs 11 to become disengaged from the panel's locking slots 39.

Figure 11A:
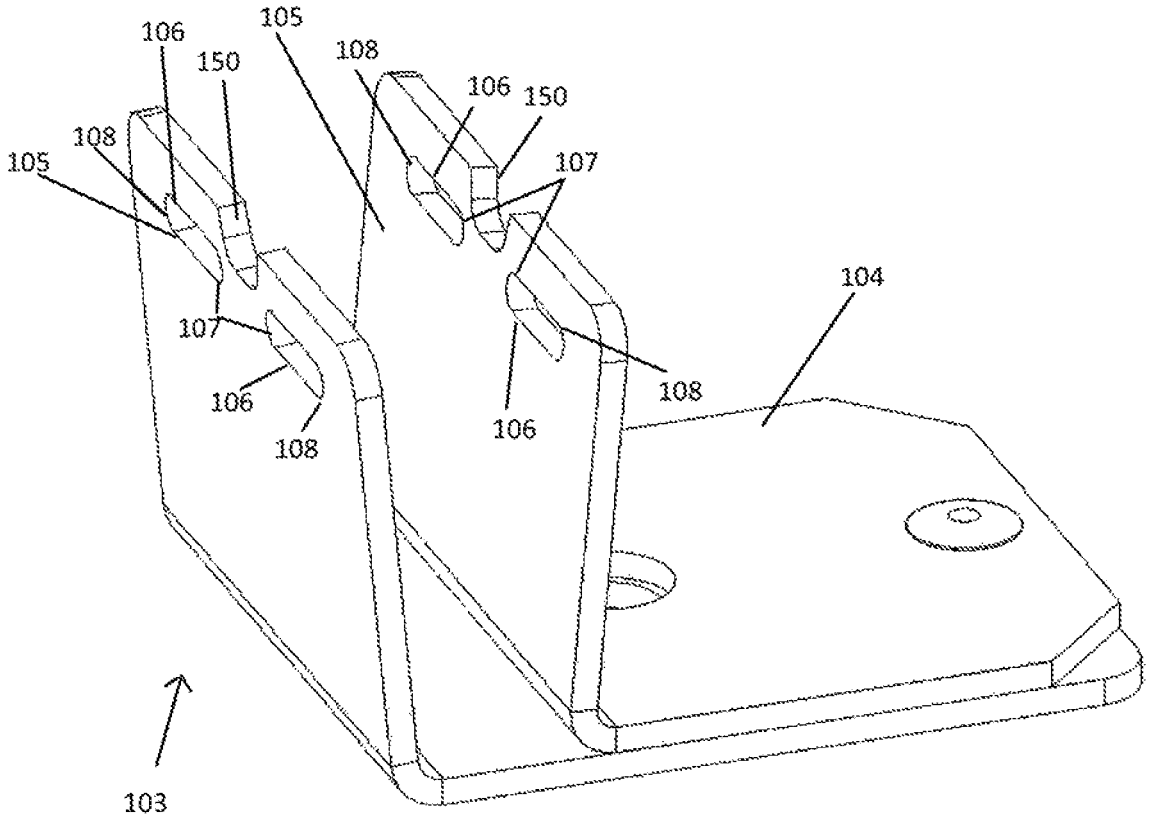
FIG. 11*a* is a perspective view of an alternative embodiment of the latching assembly's base bracket.
Figure 11B:
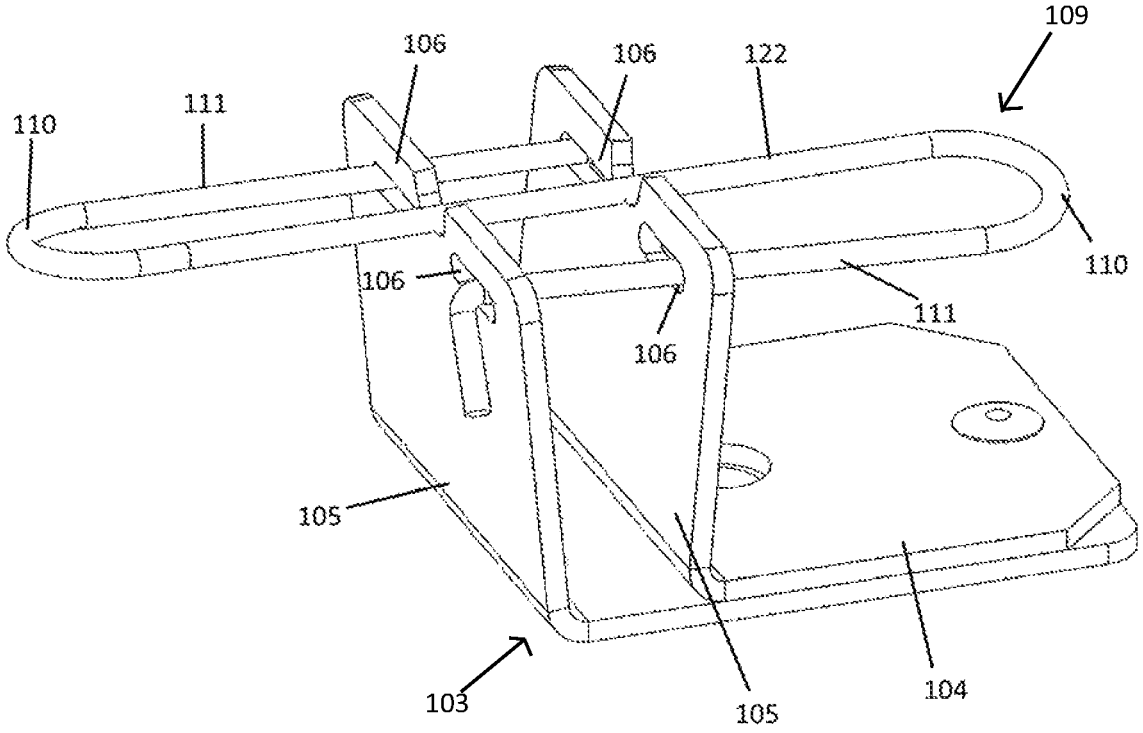
FIG. 11*b* is a perspective view of an alternative embodiment of the latching assembly's base bracket and resilient beam.
Figure 11C:
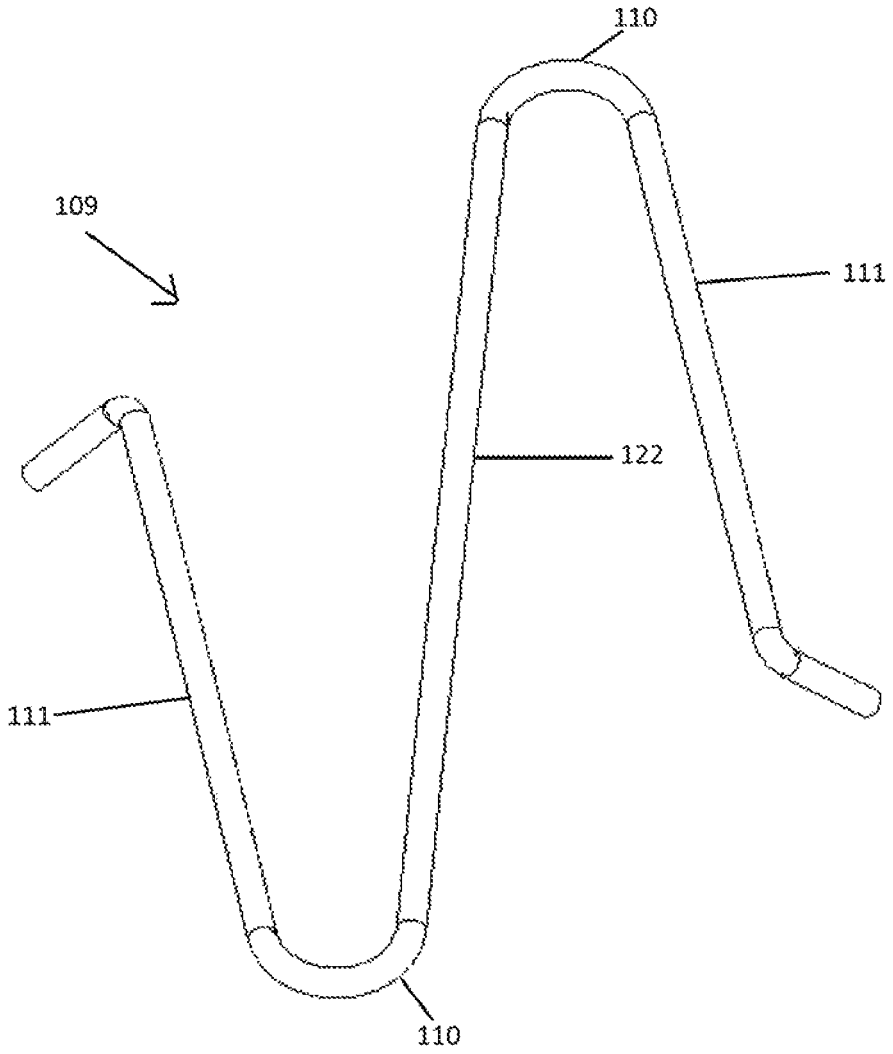
FIG. 11*c* is a perspective view of an alternative embodiment of the latching assembly's resilient beam.
Figure 12:
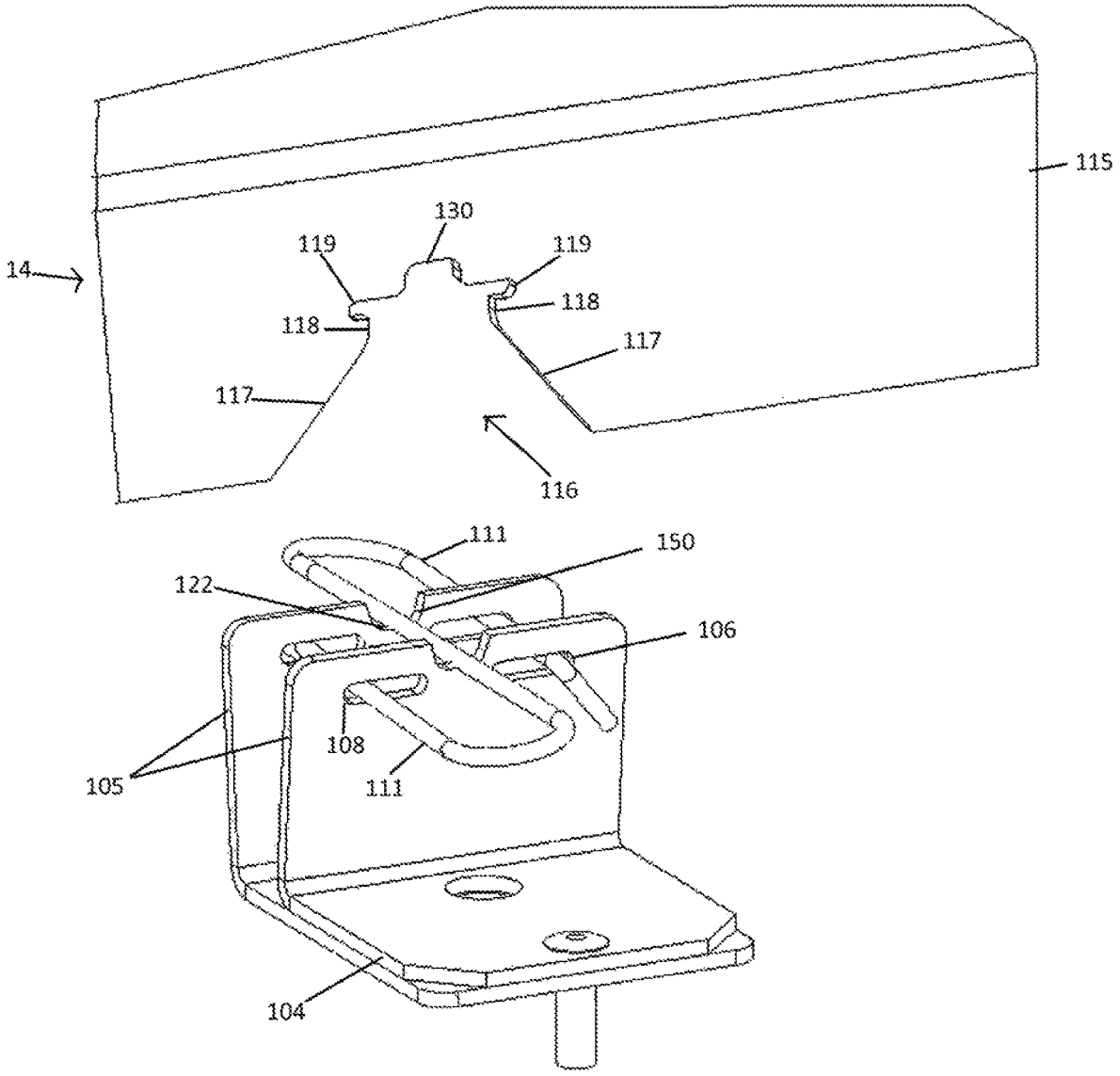
FIG. 12 is a partial exploded view depicting the alternative embodiment of the latching assembly and panel shown in FIGS. 11*a*-11*c*.

Referring now to FIGS. 11-13, another alternative embodiment of the wall and ceiling panel system 1 is shown whereby the resilient beam 109 consists of a sinusoidal-shaped metal wire. The sinusoidal-shaped resilient beam 109 can feature a first end dynamically attached to the base bracket 103 at a first position, a second end dynamically attached to the base bracket 103 at a second position, and a linear body portion 122 supported by the projecting walls 105 of the base bracket 103.

As shown in FIGS. 11*a*-11*c*, the base bracket 103 includes elements that allow it to be secured to any type of substrate or supporting surface. The base bracket 103 can include an interface surface 104 and projecting walls 105. The projecting walls 105 are disposed over the interface surface 104. Further, in one embodiment, at least one of the projecting walls 105 may be integrally formed with interface surface 104. In a further embodiment, the projecting wall 105 that is integrally formed with interface surface 104 may be disposed at one end of interface surface 104, such that fixed base bracket 103 has an approximately L-shaped appearance (or a stacked L-shaped appearance when viewing both projecting walls 105 along with interface surface 104). Each projecting wall 105 can have two elongated holes 106 disposed on the projecting wall 105. Elongated holes 106 are for retention of the wire spring 109 in the fixed base bracket 103. Each projecting wall 105 also has a centering slot 150, located approximately midway in the top of the projecting wall, which retains the linear body portion 122 of the resilient beam 109. The resilient beam 109 can be defined by flexible curved body portions 110, two legs 111, and a linear body portion 122, as shown in FIG. 11*c*. The linear body portion 122 connects the two curved body portions 110. Each leg 111 is attached to one of the curved body portion 110 at the opposite side of the curved body portion 110 from the linear body portion 122, forming a sinusoidal-shaped resilient beam 109. The flexible curved body portions 110 allows elastic movement of the legs 111. In one embodiment, resilient beam 109 may be a flat, sinusoidal-shaped wire spring, as shown FIG. 11*c*. Resilient beam 109 may be made from any material that will function to hold the load exerted on the resilient beam 109 by an attached panel 14.

Still referring to FIGS. 11*a*-11*c*, the elongated holes 106 of the base bracket 103 are shown disposed in a plane substantially parallel to the interface surface 104. However, in alternative embodiments, the elongated holes 106 can be angled relative to both the interface surface 104 and each other. Each elongated hole 106 comprises an inner edge 107 and an outer edge 108. Elongated holes 106 are sufficiently wide to allow the free motion of the wire spring legs 111, which are disposed through corresponding pairs of elongated holes 106 in projecting walls 105, as shown in FIG. 11*b*. The legs 111 are preloaded outwardly and constrained by the outer edge 108 of the elongated holes 106. The wire spring legs 111 are also constrained to move inwardly (when an inwardly directed force is applied to wire spring legs 111) by the length of the elongated holes 106 limited by the inner edge 107 of such elongated holes 106. In this embodiment, fixed base bracket 103 is configured to facilitate manufacturing.

Referring now to FIG. 12, a panel 14 configured for use with a latching assembly 102 having a sinusoidal-shaped resilient beam 109 is shown. The panel 14 can comprise a keyed flange 115 having a latching cut 116 configured for engagement with the sinusoidal-shaped resilient beam 109. The latching cut 116 can comprise ramps 117, noses 118, locking slots 119, and a central holding slot 130. Ramps 117 are angled portions of latching cut 116 that are located on opposing sides of latching cut 116. Noses 118, are formed at the end of ramp 117 that is closest to the rear surface of panel 14, and form a section of latching cut 116 that is substantially perpendicular to the rear surface of panel 14. Locking slots 119, are located on the opposite side of nose 118 from the ramp 117, and form a groove or slot that the legs 111 engage when the panel 14 is installed. During insertion of the panel into fixed latching bracket 102, the ramps 117 located in both sides of the latching cuts 116, engage the legs 111. As the latching cut 116 is pushed between projecting walls 105 of the fixed latching bracket 102, the ramps 117 force the wire spring legs 111 inwardly within the elongated holes 106 towards inner edge 107. At the end of the ramps 117, the nose 118 delimits the locking slot 119 at the bottom end of the latching cut 116. As the panel 14 containing the latching cuts 116 is being pushed against the force of the wire spring legs 111, which are displaced within the elongated holes 106, the wire spring legs 111 are forced over the tip of the nose 118 and spring outwardly towards the locking slots 119 at the bottom of the latching cut 116. Once the wire spring legs 111 are positioned in locking slots 119, the linear body portion 122 of wire spring 109 is positioned in spring holding slot 130. The interaction between the latching cut 116, elongated holes 106, and resilient beam 109 function to center the keyed flange 115 in the bracket 103. Spring holding slot 130 and centering slot 150 also restricts lateral motion of the panel.

Figure 13A:
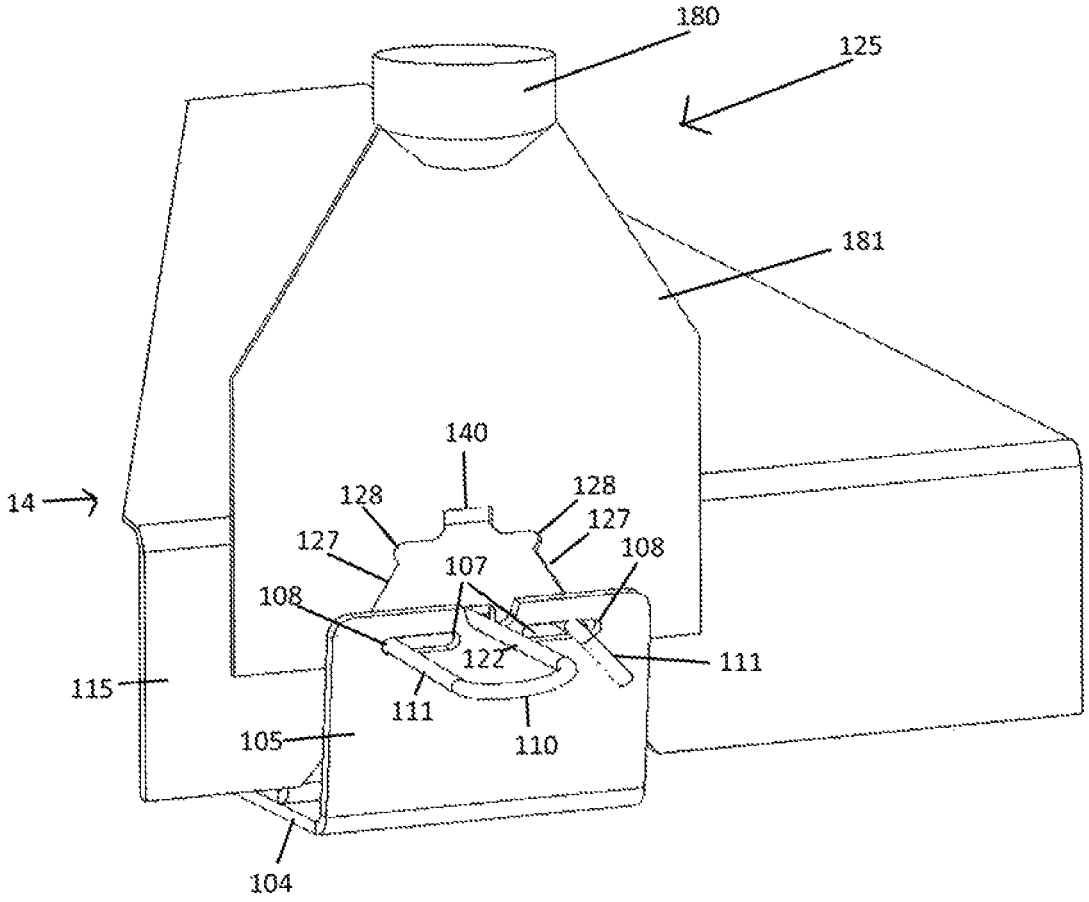
FIG. 13*a* is a perspective view depicting the alternative embodiment of the latching assembly and panel shown in FIGS. 11*a*-11*c* in addition to an alternative embodiment of a removal tool.
Figure 13B:
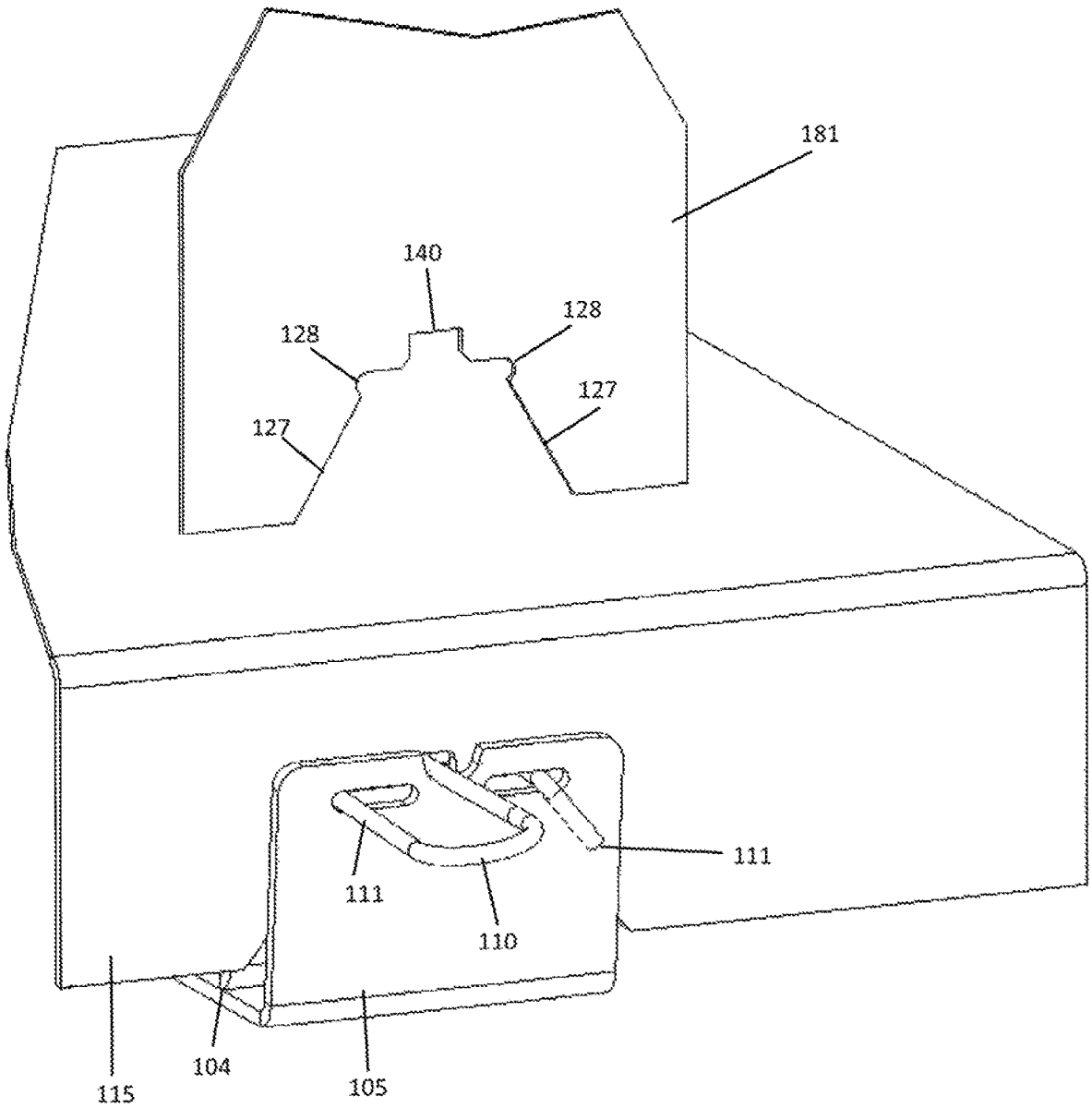
FIG. 13*b* is another perspective view depicting the alternative embodiment of the latching assembly and panel shown in FIGS. 11*a*-11*c* in addition to the alternative embodiment of the removal tool.
Figure 14:
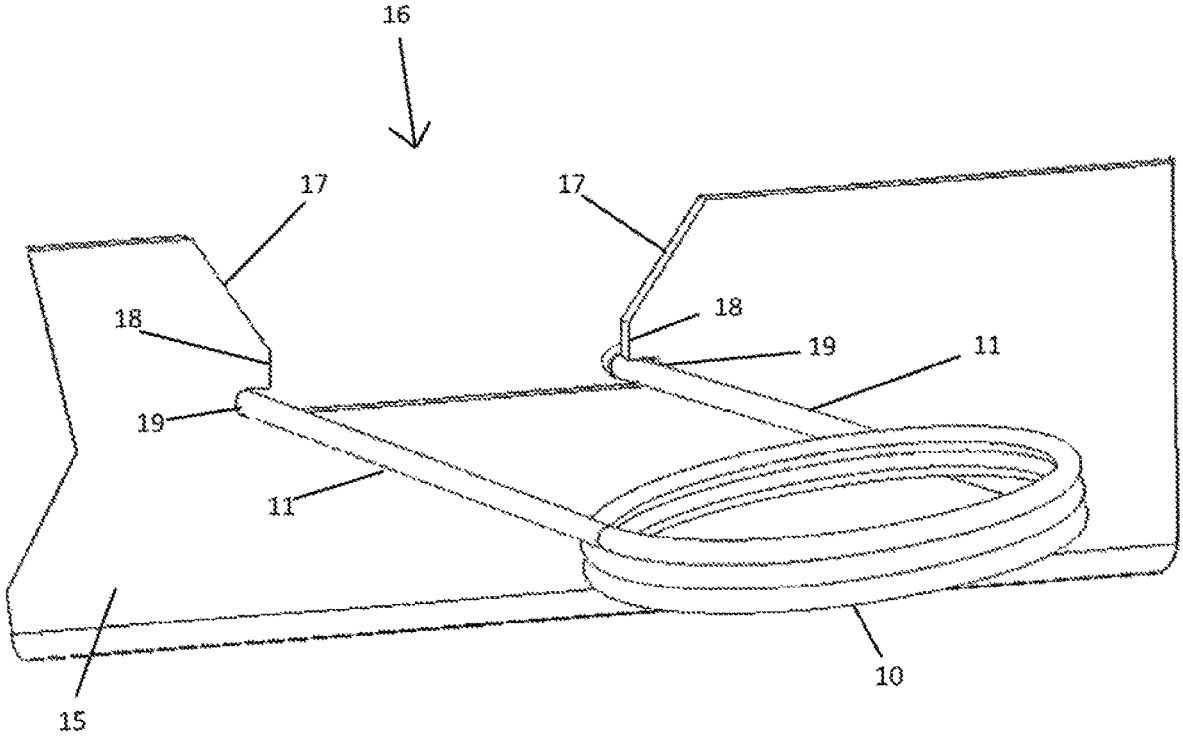
FIG. 14 is a perspective view of an embodiment of the latching assembly's resilient beam coupled to an embodiment of the panel.
Figure 15:
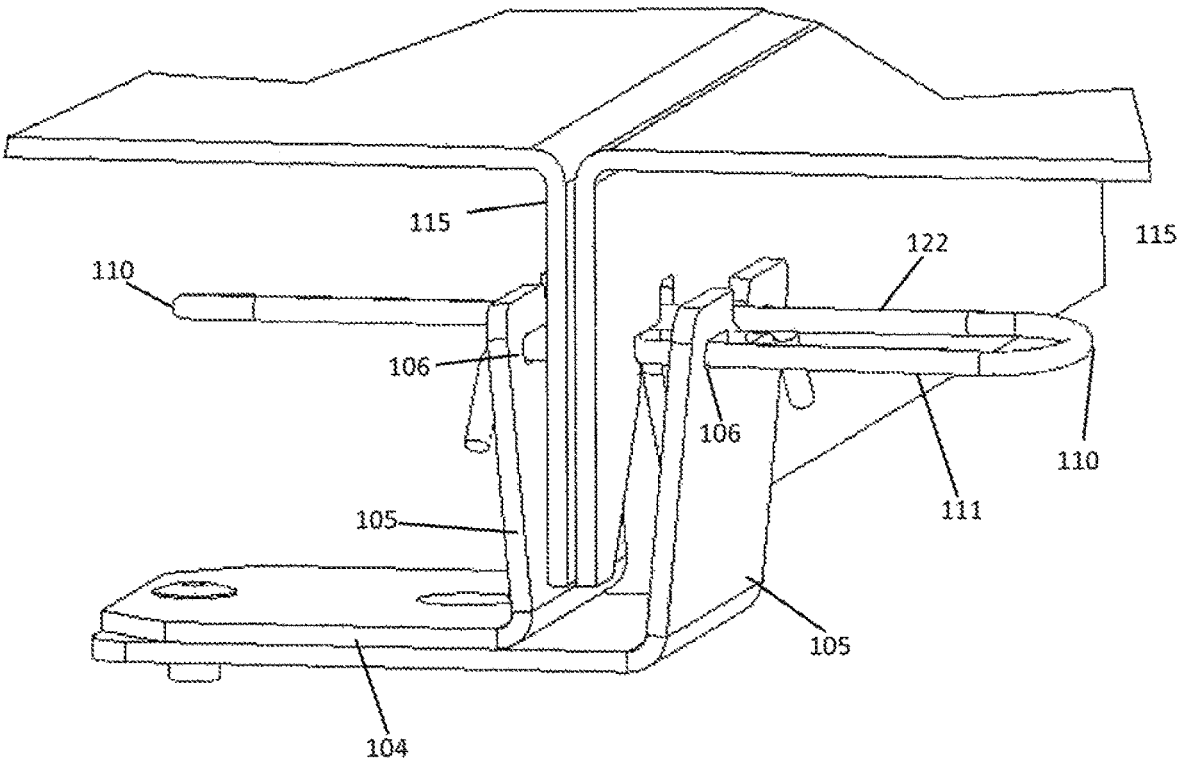
FIG. 15 is a perspective view of an embodiment of the wall and ceiling panel system whereby two panels mounted to an embodiment of the latching assembly is depicted.
Figure 16:
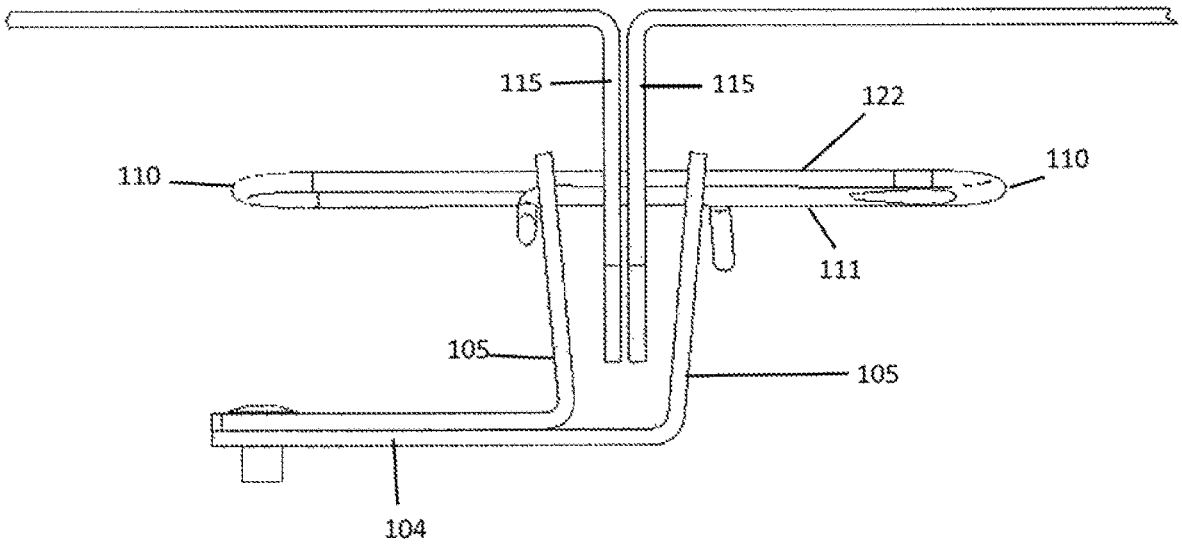
FIG. 16 is a side view of the embodiment of the wall and ceiling panel system depicted in FIG. 15 whereby two panels mounted to an embodiment of the latching assembly is depicted.

As shown in FIGS. 13*a* and 13*b*, a removal tool 125 can be utilized to remove the panel(s) 14 from the latching assembly 102 by forcibly deforming the legs 111 of the resilient beam 109 to decouple the resilient beam 109 from the locking slots 119 of the keyed flange 115. The removal tool 125 is sized so that it is capable of being inserted between adjacent panels. The removal tool 125 can comprise a handle 180 and a blade 181. The blade 181 comprises a cut section 126 that is similarly shaped—but of smaller dimensions—to the one or more latching cuts 116 of the keyed flange 115. In operation, the removal tool's ramps 127 will slidably engage the legs 111 of the resilient beam 109, causing the legs 111 to deflect inwardly towards the inner edge 107 of the elongated slots 106. This disengages the legs 11 from the keyed flange's locking slots 119. The removal tool 125 can further comprise tool cutout pockets 128 to allow the removal tool 125 to remain engaged to the resilient beam 9 as the panel 14 is being removed.

Many modifications and other embodiments of the invention set forth herein will come to mind to one skilled in the art having the benefit of the teaching presented in the foregoing description and associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A panel anchoring system comprising:

a) a latching assembly comprising a resilient beam movably coupled to a base bracket so as to allow the resilient beam to deflect, wherein the resilient beam comprises a first leg and a second leg, wherein the base bracket comprises a first projecting wall and a second projecting wall, and wherein the first leg of the resilient beam is movably coupled to an elongated hole in the first projecting wall and an elongated hole in the second projecting wall; and b) a panel comprising a keyed flange configured for releasable attachment to the resilient beam, the keyed flange having at least one locking slot.

2. The panel anchoring system of claim 1, wherein the at least one locking slot of the keyed flange is configured for releasable attachment to the first leg of the resilient beam to secure the panel to the latching assembly.

3. The panel anchoring system of claim 1, wherein the keyed flange of the panel further comprises at least one ramp positioned adjacent to the at least one locking slot.

4. The panel anchoring system of claim 1, wherein the resilient beam is a U-shaped loop spring.

5. The panel anchoring system of claim 4, wherein the U-shaped loop spring comprises a semi-circular body portion disposed between the first leg and the second leg.

6. The panel anchoring system of claim 5, wherein the second leg of the resilient beam is movably coupled to a second elongated hole in the first projecting wall and a second elongated hole in the second projecting wall.

7. The panel anchoring system of claim 6, wherein the keyed flange of the panel further comprises a first ramp positioned adjacent to a first locking slot, and comprises a second ramp positioned adjacent to a second locking slot, and wherein the first and second locking slots of the keyed flange are configured for releasable attachment to the first and second legs of the resilient beam.

8. The panel anchoring system of claim 7, further comprising a removal tool for detaching the first and second legs of the resilient beam from the first and second locking slots of the keyed flange, wherein the removal tool comprises a handle and a blade, the blade having a cut section comprising a first ramp adjacent to a first cutout pocket and a second ramp adjacent to a second cutout pocket.

9. A panel anchoring system comprising:

a) a latching assembly comprising:

i) a base bracket, the base bracket comprising first and second projecting walls, the first and second projecting walls each having one or more elongated holes; and ii) a resilient beam movably coupled to the base bracket so as to allow the resilient beam to deflect, the resilient beam comprising a first leg and a second leg, wherein the first leg of the resilient beam is movably coupled to a first elongated hole in the first projecting wall and a first elongated hole in the second projecting wall, and wherein the second leg of the resilient beam is movably coupled to a second elongated hole in the first projecting wall and a second elongated hole in the second projecting wall; and b) a panel comprising a keyed flange, the keyed flange comprising:

i) first and second locking slots configured for releasable attachment to the first and second legs of the resilient beam; and ii) first and second ramps, with the first ramp being positioned adjacent to the first locking slot, and with the second ramp being positioned adjacent to the second locking slot.

10. The panel anchoring system of claim 9, wherein the resilient beam is a U-shaped loop spring.

11. The panel anchoring system of claim 10, wherein the U-shaped loop spring comprises a semi-circular body portion disposed between the first leg and the second leg.

* * * * *